US006941912B2

(12) United States Patent
Palesch et al.

(10) Patent No.: US 6,941,912 B2
(45) Date of Patent: Sep. 13, 2005

(54) DEVICE AND METHOD FOR THE RELATIVE ROTATIONAL ADJUSTMENT OF A CAMSHAFT AND A DRIVE WHEEL OF AN INTERNAL COMBUSTION ENGINE

(75) Inventors: Edwin Palesch, Lenningen (DE); Gordon Neudoerfer, Ulm-Moehringen (DE); Holger Schwarz, Nuertingen (DE)

(73) Assignees: Dr. Ing. h.c.F. Porsche Aktiengesellschaft, Stuttgart (DE); Hydraulik Ring GmbH, Nuertingen (DE)

( * ) Notice: Subject to any disclaimer, the term of this patent is extended or adjusted under 35 U.S.C. 154(b) by 0 days.

(21) Appl. No.: 10/847,479

(22) Filed: May 18, 2004

(65) Prior Publication Data

US 2004/0211379 A1 Oct. 28, 2004

Related U.S. Application Data

(63) Continuation of application No. PCT/EP03/00627, filed on Jan. 23, 2003.

(51) Int. Cl.[7] ..... F01L 1/34

(52) U.S. Cl. ..... 123/90.17; 123/90.15; 123/90.31

(58) Field of Search ..... 123/90.15, 90.17, 123/90.31

(56) References Cited

U.S. PATENT DOCUMENTS 5,197,421 A * 3/1993 Hara ..... 123/90.17
5,367,992 A * 11/1994 Butterfield et al. ..... 123/90.17
5,657,725 A 8/1997 Butterfield et al.
6,173,685 B1 * 1/2001 Sturman ..... 123/90.12
6,302,072 B1 10/2001 Sekiya et al.
6,332,438 B1 * 12/2001 Machida ..... 123/90.17

FOREIGN PATENT DOCUMENTS

DE 100 33 229 A1 1/2002
EP 1 008 729 A3 6/2000
EP 1 008 729 A2 6/2000

* cited by examiner

*Primary Examiner*—Thomas Denion
*Assistant Examiner*—Zelalem Eshete
(74) *Attorney, Agent, or Firm*—Crowell & Moring LLP

(57) ABSTRACT

A device and method for the relative adjustment of the angle of rotation of a camshaft with respect to the crankshaft of an internal combustion engine that utilizes a hydraulically activated actuating element, through the adjustment of which the phase position of the camshaft can be directly or indirectly changed. The actuating element is bordered by two pressure chambers, which can be loaded with or relieved of hydraulic fluid via control lines. A control valve is provided, which, depending upon an operating state of the internal combustion engine, forces a flow of oil that is forced from an oil reservoir by an oil pump via a first control line to a first pressure chamber, while oil from a second pressure chamber is returned to the oil reservoir via a second control line, and vice versa. At least one controlled bypass is arranged between the two pressure chambers. In this manner, the speed of adjustment of the camshaft adjuster can be advantageously increased.

5 Claims, 29 Drawing Sheets

DEVICE AND METHOD FOR THE RELATIVE ROTATIONAL ADJUSTMENT OF A CAMSHAFT AND A DRIVE WHEEL OF AN INTERNAL COMBUSTION ENGINE

CROSS-REFERENCE TO RELATED APPLICATIONS

This application is a continuation of PCT Application No. PCT/EP03/00627, filed on Jan. 23, 2003 (Jan. 23, 2003).

BACKGROUND AND SUMMARY OF THE INVENTION

This application claims the priority of German patent document 102 05 415.0, filed Feb. 9, 2002, the disclosure of which is expressly incorporated by reference herein.

The invention relates to a device and method for use in the relative adjustment of the angle of rotation of a camshaft of an internal combustion engine with respect to a drive wheel. Preferred embodiments of the invention relate to the use of hydraulically actuated actuating elements for adjusting the relative rotational angle of the camshaft and drive wheel.

Various devices used in camshaft adjustment are known in the art (see e.g., the textbook "Fachkunde Kraftfahrzeugtechnik" [Handbook of Motor Vehicle Technology], 26th Edition, 1999, pages 272, 273). Two different designs of a camshaft adjustment device are described in the cited literature. In a first design, the exhaust camshaft drives the intake camshaft via a chain drive. Via the hydraulic adjustment of a chain tensioner arranged between the chain drive, the turning position of the intake camshaft can be shifted relative to the exhaust camshaft, allowing the valve timing to be adjusted as desired. In a second design of a camshaft adjustment device, it is provided, for example, that the intake camshaft is twisted relative to the camshaft drive wheel. In this example, a hydraulic piston that can be shifted to the left or the right is provided, whose axial movement in a mechanical adjustment unit with a helical gear effects an adjustment of the camshaft in the "advanced" or "delayed" direction. In addition to the above-described designs, so-called vane-cell camshaft adjusters are known (see e.g., EP 1 008 729 A2 corresponding to U.S. Pat. No. 6,302,072) in which the camshaft can again be adjusted relative to the camshaft drive wheel. The common factor in all of the above-named designs of a camshaft adjustment device is that the adjustment is accomplished hydraulically, wherein hydraulic lines that lead to two different pressure spaces or pressure chambers are provided, via which the actual actuating element of the camshaft adjuster can be shifted as desired to the left or to the right with the help of a control valve.

As is commonly known, with camshaft adjustment on the intake side, for example, the cylinder charge can be substantially improved over a broad speed range. In order to accomplish this, however, it is necessary for a hydraulic adjustment system of this type to operate with short delay times, or to guarantee a high adjustment speed. The adjustment speed of the camshaft adjuster is limited, however, because the oil that is required for loading pressure into the hydraulic chambers must first be drawn from an oil tank, e.g., the oil pan of the internal combustion engine. The problem with this is that at high oil temperatures, a smaller quantity of oil is available due to increased leakage in the oil lead; this reduces the speed of adjustment of the camshaft adjuster.

It is thus an object of the invention to improve the feed of hydraulic oil to a camshaft adjuster, in order to enable more rapid response or reaction times to camshaft adjustment.

This object is attained according to the invention by providing a controlled bypass arranged between the pressure chamber of the camshaft adjuster.

According to certain preferred embodiments of the invention, because a bypass line that can be controlled via a valve element is provided between the two control lines that lead to the pressure chambers of the camshaft adjuster, under certain operating conditions of the internal combustion engine, the oil that flows out of the depressurized hydraulic chamber can be fed directly to the pressurized control line or pressure chamber, avoiding the oil tank. In this manner, despite higher oil temperatures, the speed of adjustment of the camshaft adjuster can be improved relative to the known systems.

In certain preferred embodiments of the invention, the activation of the connection that exists between the two pressure chambers takes place in particular when the oil pressure in the non-activated pressure chamber of the adjustment unit is greater than the oil pressure in the activated pressure chamber that is being supplied with oil via a hydraulic line for adjustment of the camshaft. These pressure conditions can be present when an additional amount of torque is acting upon the camshaft in the direction of adjustment; a moment of rotation of this nature can be generated, for example, by closing the valves in the transfer to cam and camshaft, and thus to the adjustment unit.

Further advantages and advantageous improvements on the invention are disclosed in the claims and in the description.

In certain preferred embodiments of the invention, in a first advantageous design, the bypass that connects the two pressure chambers is integrated directly into the camshaft adjustment unit. This involves a so-called vane-cell camshaft adjuster, in which an inner component (rotor) is connected to the camshaft so that it cannot rotate, which rotor has vanes that extend from it at least nearly radially and are encompassed by a drive wheel, and has several cells that are distributed around its periphery and are separated by fixed members, so that, in each case, two pressure chambers are formed between the vanes of the inner component and the fixed members of the drive wheel. With this design, which is integrated into the camshaft adjuster, the hydraulic fluid can be conveyed via the shortest pathway from one pressure chamber to another. This allows extremely short adjustment times to be realized.

In certain preferred embodiments of the invention, a particularly compact construction that has low losses from leakage is achieved when the valve pin that is necessary for the shifting of the bypass system that is integrated into the camshaft adjuster is positioned in the inner component (rotor) of the adjustment unit.

In certain preferred embodiments of the invention, in one vane of the inner component, four bores are provided that serve to hold the valve pins. With the interaction of the four valve pins, on one hand, the oil supply from the oil tank to the two pressure chambers, and on the other hand, the bypass between the two pressure chambers, are controlled.

In certain preferred embodiments of the invention, in an advantageous manner, one valve pin is also designed as a locking element that acts between the inner component and the drive wheel.

In certain preferred embodiments of the invention, in a second advantageous design, the valve-controlled bypass is integrated between the two pressure chambers in the control valve.

In certain preferred embodiments of the invention, a simple and reliable shifting of the bypass that is integrated into the solenoid-control valve is characterized in that two valve actuators are arranged on a valve pin so that they can shift, and in that the valve actuators are provided with ring collars that control openings that lead to the control lines.

In certain preferred embodiments of the invention, in a third advantageous design, a reversing valve is provided in an oil tank line that leads to the control valve, which reversing valve is connected via a controllable line connection to a second oil tank line. In this manner, a controllable bypass between the two control lines that lead to the two pressure chambers is produced.

Three exemplary designs of the invention are described in greater detail in the following description and drawings.

Other objects, advantages and novel features of the present invention will become apparent from the following detailed description of the invention when considered in conjunction with the accompanying drawings.

DETAILED DESCRIPTION OF THE DRAWINGS

Figure 1A:
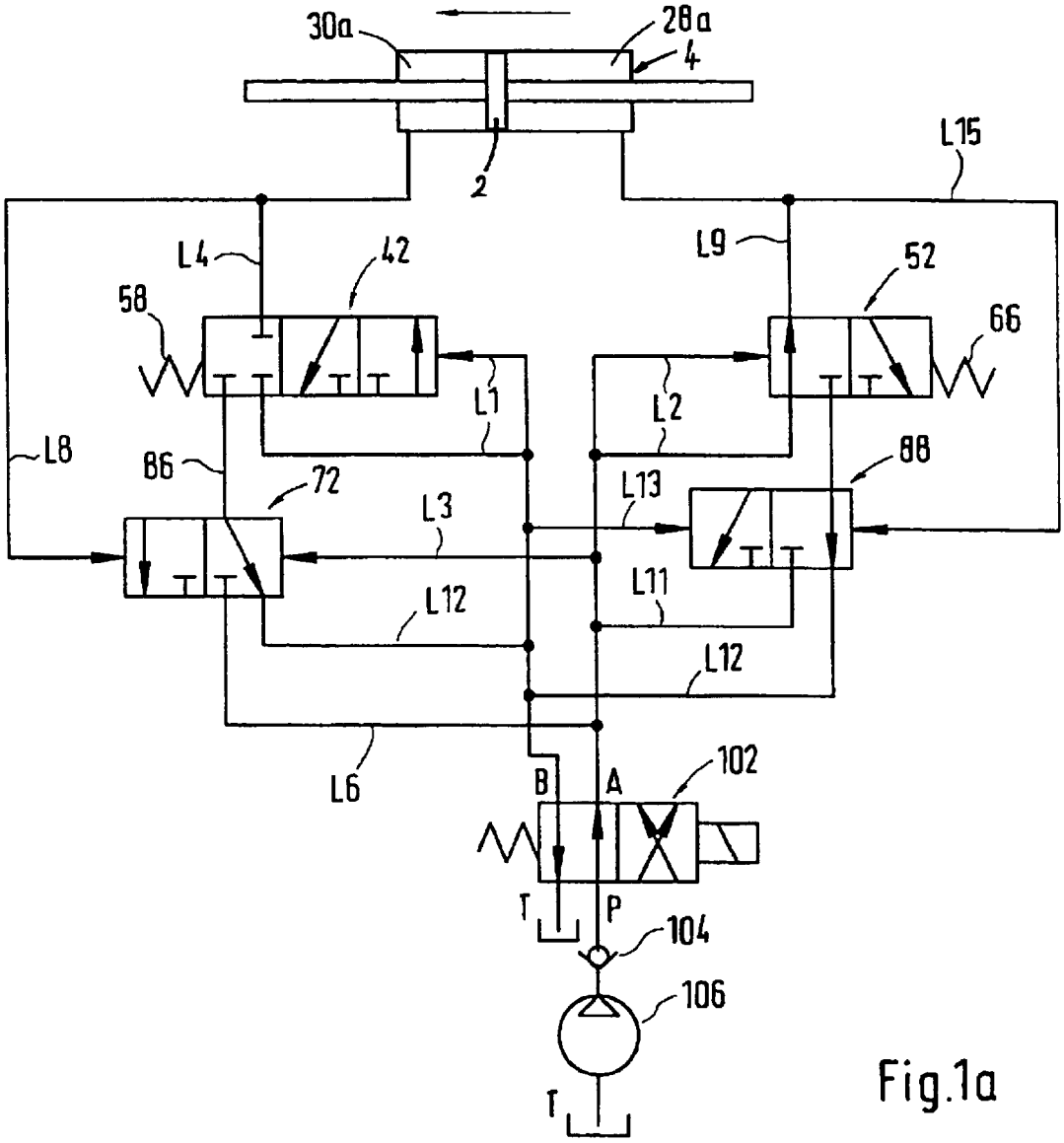
FIG. 1*a* is a hydraulic flow diagram for a camshaft adjustment arrangement constructed according to a first preferred embodiment of the invention.
Figure 1B:
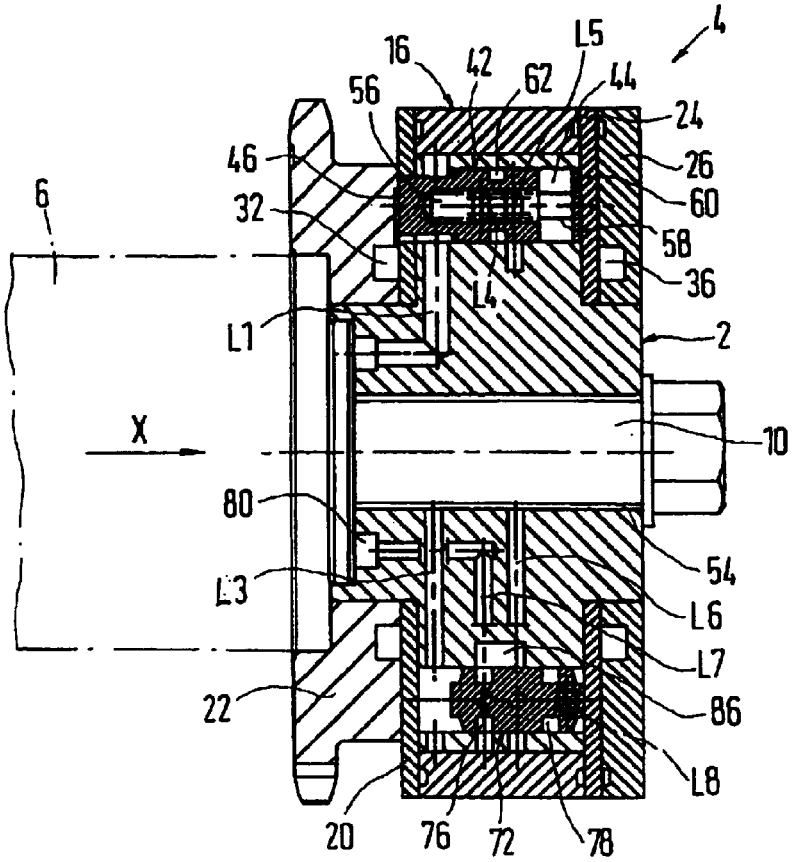
FIG. 1*b* is a first cross-sectional view of a vane-cell camshaft adjuster for use with the arrangement of FIG. 1.
Figure 1C:
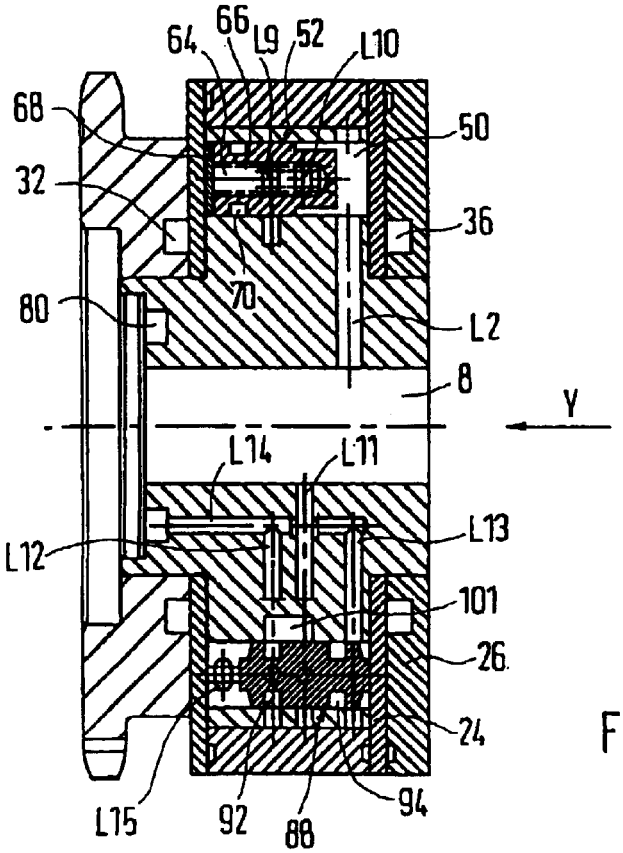
FIG. 1*c* is a second cross-sectional view of the vane-cell camshaft adjuster of FIG. 1*b;*

First, the constructive design of the camshaft adjuster according to the first exemplary design illustrated in FIGS. 1*b* through 1*f* shall be described. The inner component of an adjustment unit 4, hereinafter referred to as the rotor 2, is mounted on the open end of a camshaft 6, which is only schematically represented here. The rotor 2 is also equipped with a central bore 8, which is continued in the camshaft 6 and to which is connected a threaded bore (not illustrated here) which is smaller in diameter. In the bore 8, a screw 10 is fed, which serves to fasten the rotor 2 to the camshaft 4. In the present exemplary design, the rotor 2 is provided with three radially arranged vanes 12*a* through 12*c* that extend outward from a hub 14 of the rotor 2. The rotor 2 is encompassed by a cell wheel 16 in the area of its vanes 12*a* through 12*c,* wherein this cell wheel is equipped with three radial fixed members 18*a* through 18*c* that extend inward. The cell wheel 16 that forms the stator of the adjuster unit 4 is bordered on its end surface that faces the camshaft 6 by a first stationary seal ring 20, to which a sprocket 22 for driving the camshaft 6 is connected. The opposite end face of the cell wheel 16 is bordered by a second stationary seal ring 24, to which a cover plate 26 is connected. Both stationary seal rings 20, 24, the sprocket 22, and the cover plate 26 are attached to the hub 14 of the rotor 2 such that they form a seal and are free to rotate, and are firmly connected to one another via screw devices that are not illustrated here. Three cells that are bordered axially by the two stationary seal rings 20, 24 are formed by the fixed members 18*a* through 18*c* of the cell wheel 16, and are divided by the vanes 12*a* through 12*c* of the rotor 2 into two pressure chambers 28*a* through 28*c* or 30*a* through 30*c*. The pressure chambers 28*a* through 28*c* are connected to one another via a guide channel 32 that is integrated into the sprocket 22. In addition to this, in the first stationary seal ring 20, three bores 34*a* through 34*c* are provided, which empty into the pressure chambers 28*a* through 28*c*. Similarly, a second guide channel 36 is provided in the cover plate 26, and is connected to the pressure chambers 30*a* through 30*c* via bores 38*a* through 38*c* arranged in the second cover plate 24. The hydraulic fluid for the pressure chambers 28*a* through 28*c* is fed in via a bore that is positioned in the hub 14 of the rotor 2, hereinafter referred to as the line L1, which leads to the pressure chamber 28*a*. The line L1 is controlled by a valve pin, hereinafter referred to as the locking pin 42, which is taken up in a bore 44 provided in the vane 12*a*. In addition to hydraulic fluid control, the locking pin 42 also serves to lock the rotor 2 relative to the cell wheel 16. To this end, an opening 46 that corresponds to the diameter of the locking pin 42 is located in the first stationary seal ring 20, into which the locking pin 42 becomes engaged in a locked position that will be described in greater detail at a later point. The hydraulic fluid for the pressure chambers 30*a* through 30*c* is supplied via a bore that extends radially in the rotor 2, hereinafter referred to as the line L2, which leads to the pressure chamber 30*a*. The line L2 that leads to the pressure chamber 30*a* is also controlled by a valve pin, hereinafter referred to as the fixed member pin 52 that is taken up in a bore 50 of the vane 12*a*. The line L2 is connected to an annular chamber 54, which is formed between the fastening screw 10 for the adjustment unit 4 and the section of wall of the central bore 8 that is provided in the hub 14 and in the camshaft 6, wherein the annular chamber 54 is closed at the end by the head of the screw 10.

Figure 1D:
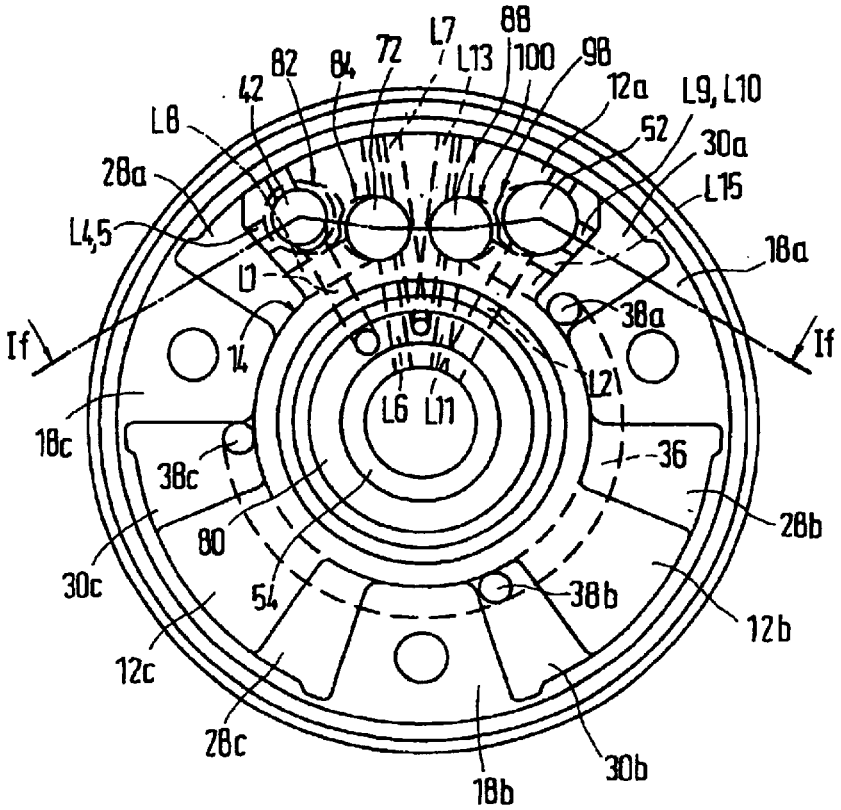
FIG. 1*d* is a first interior schematic view of one end face of the camshaft adjuster taken in the direction of arrow X in FIG. 1*b;*
Figure 1E:
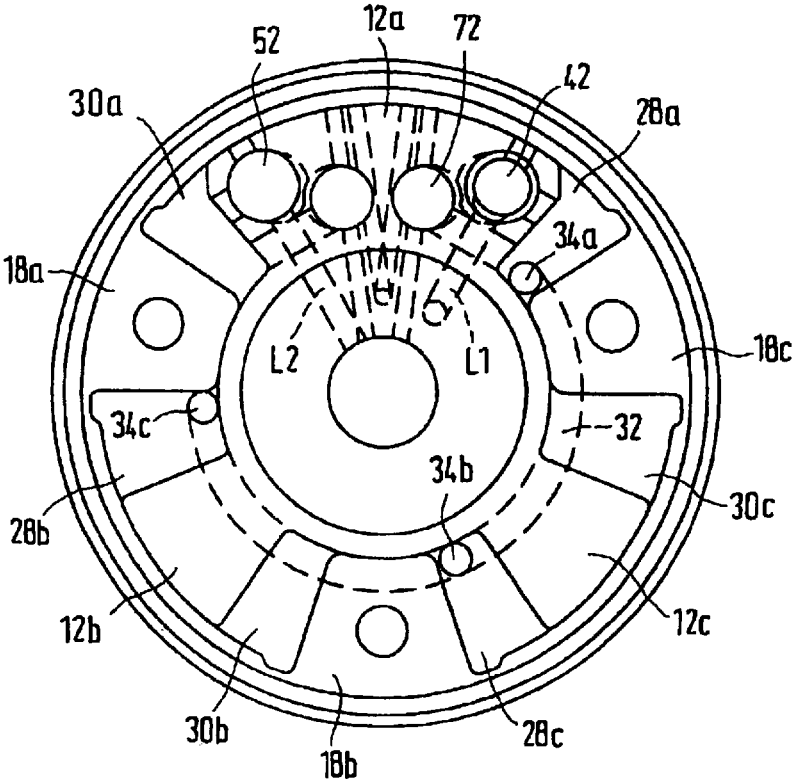
FIG. 1*e* is a second interior schematic view of an end face of the camshaft adjuster taken in the direction of arrow Y in FIG. 1*c;*
Figure 1F:
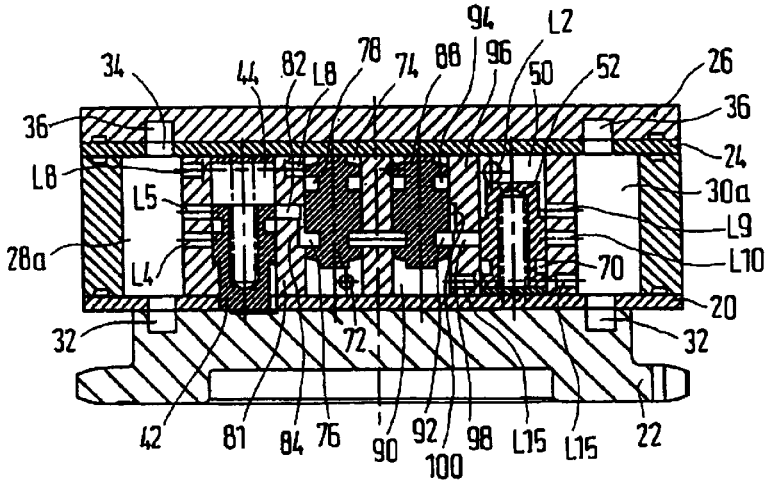
FIG. 1*f* is a cross-sectional view along the line 1*f*—1*f* in FIG. 1*d;*
Figure 2A:
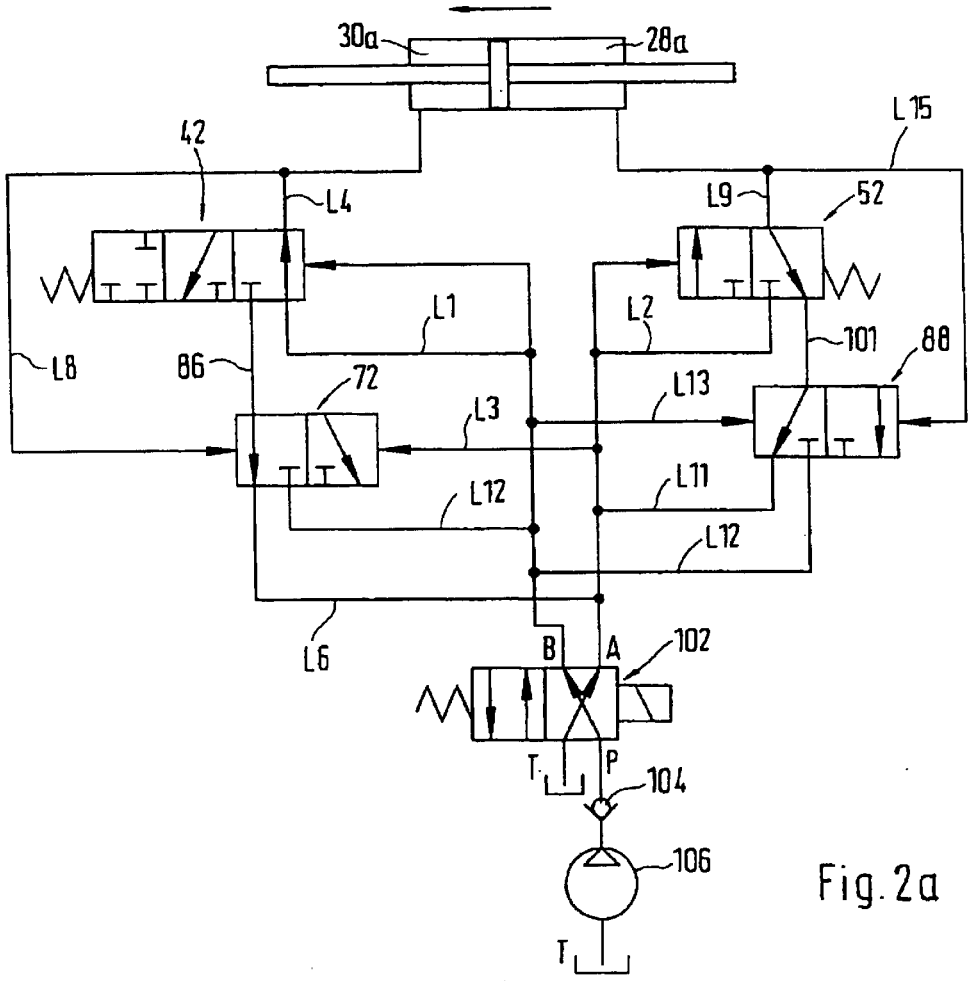
FIG. 2*a* is a hydraulic flow diagram for the arrangement of FIGS. 1*a*–1*f*, shown in a second operational state.
Figure 2B:
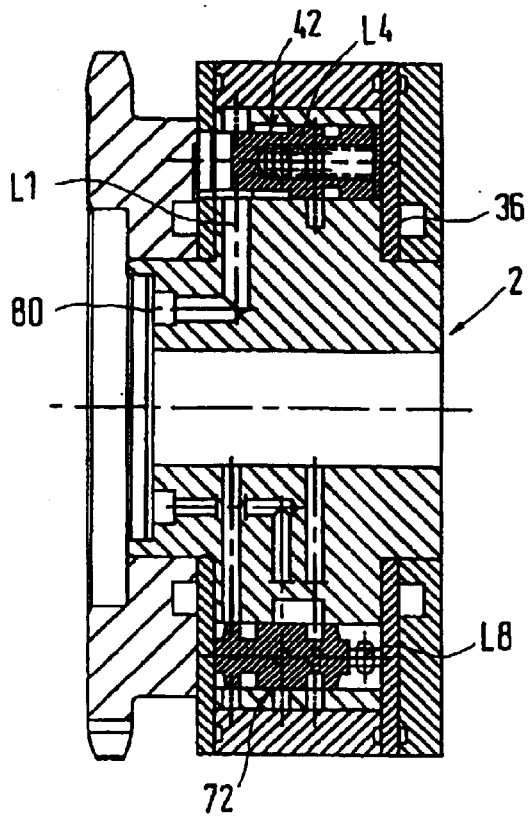
FIG. 2*b* is a view similar to FIG. 1*b,* shown in the second operational state depicted in FIG. 2*a;*
Figure 2C:
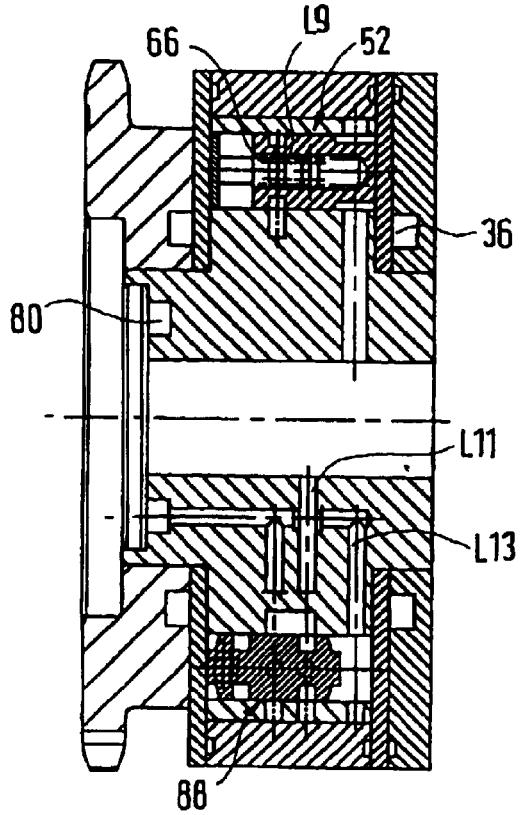
FIG. 2*c* is a view similar to FIG. 1*c,* shown in the second operational state depicted in FIG. 2*a;*
Figure 2D:
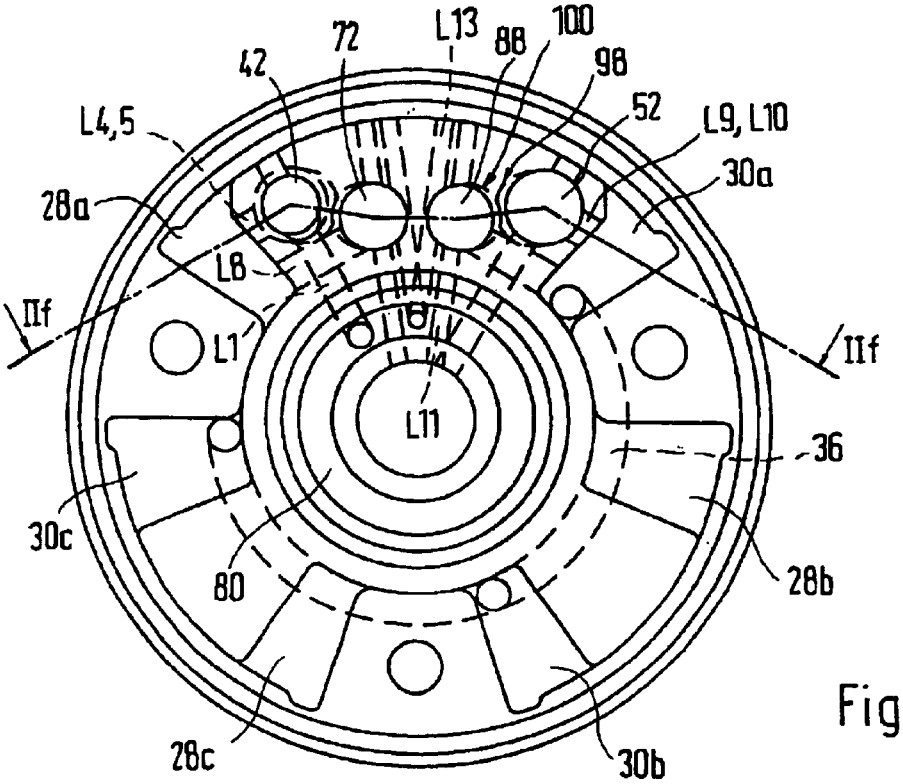
FIG. 2*d* is a view similar to FIG. 1*d,* shown in the second operational state depicted in FIG. 2*a;*
Figure 2E:
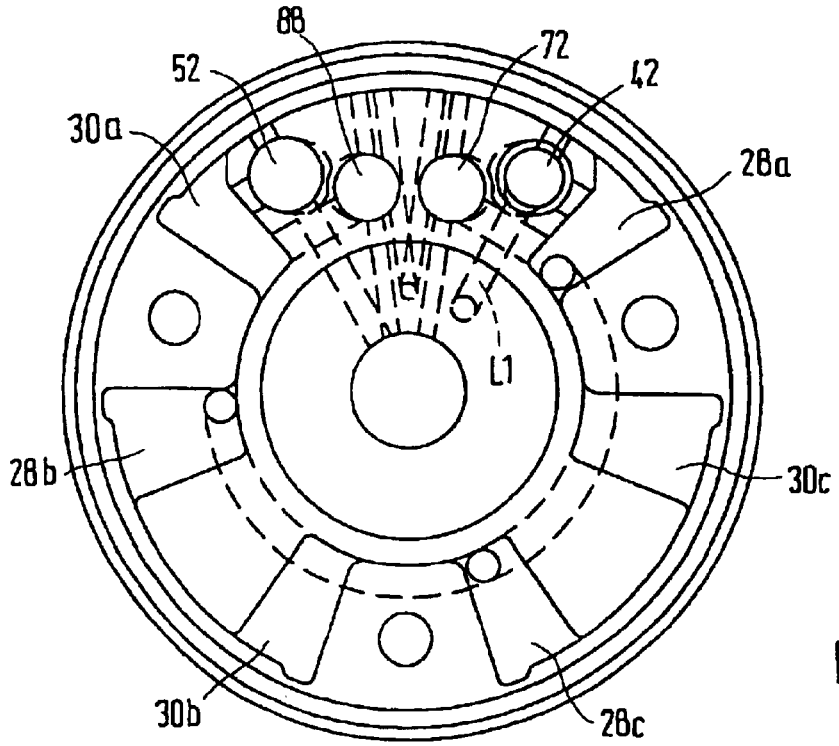
FIG. 2*e* is a view similar to FIG. 1*e,* shown in the second operational state depicted in FIG. 2*a;*
Figure 2F:
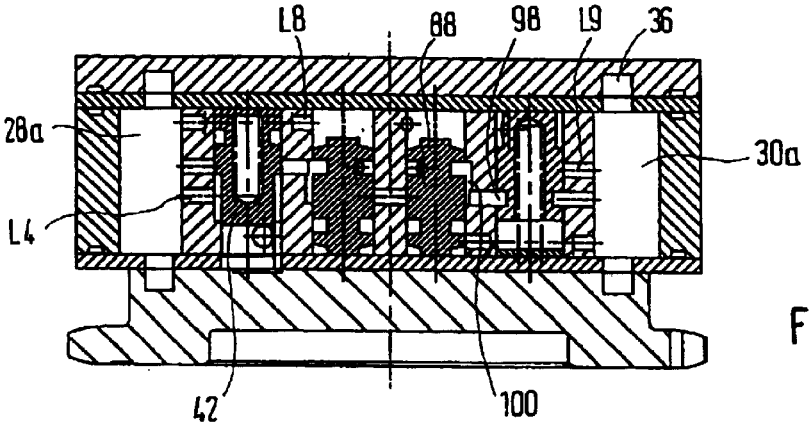
FIG. 2*f* is a view similar to FIG. 1*f,* shown in the second operational state depicted in FIG. 2*a;*
Figure 3A:
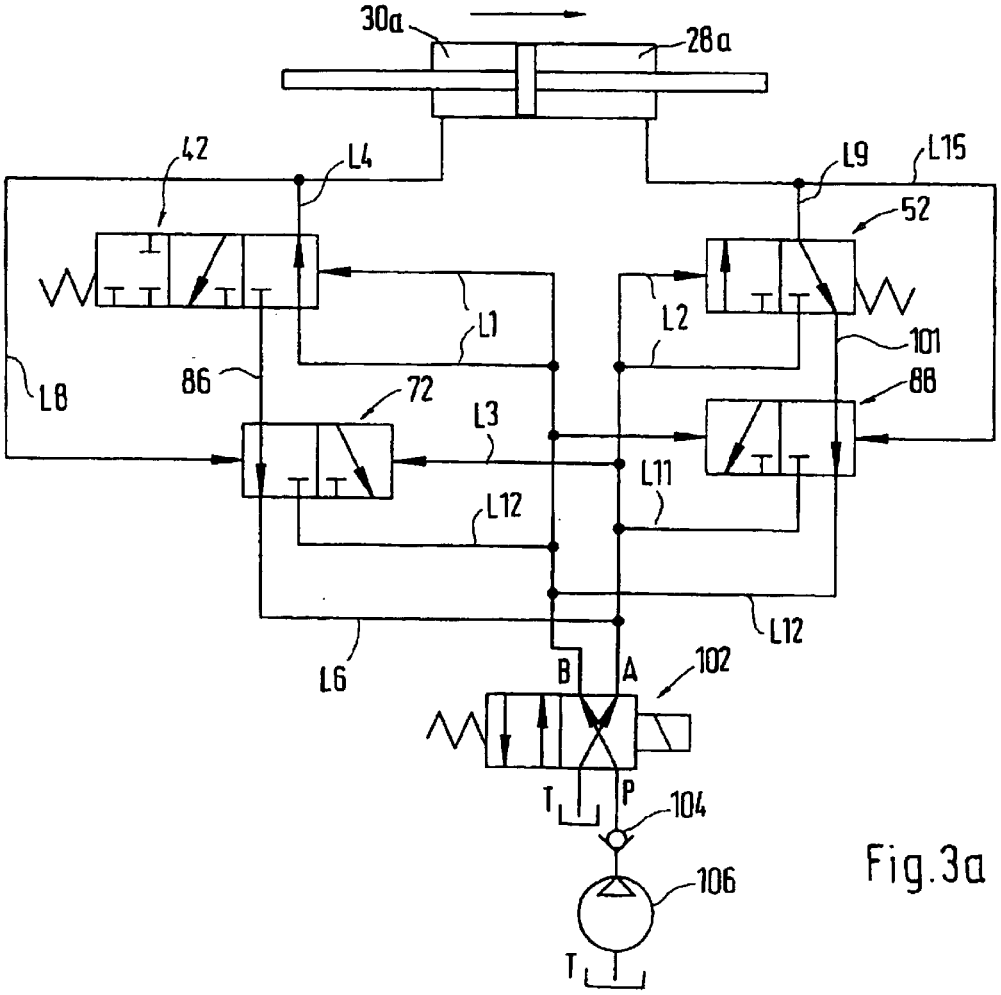
FIG. 3*a* is a view similar to FIG. 2*a,* shown in a third operational state.
Figure 3B:
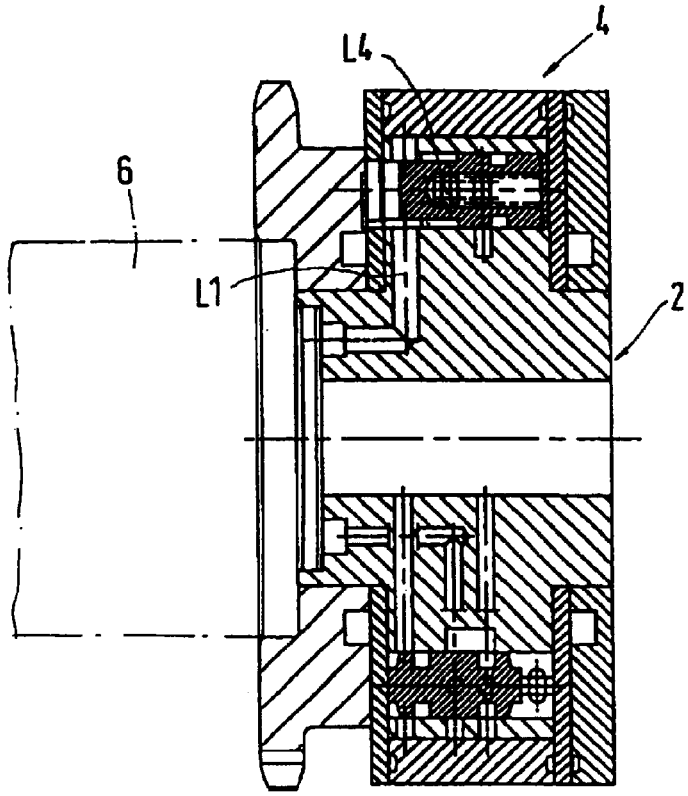
FIG. 3*b* is a view similar to FIG. 1*b,* shown in the third operational state depicted in FIG. 3*a;*
Figure 3C:
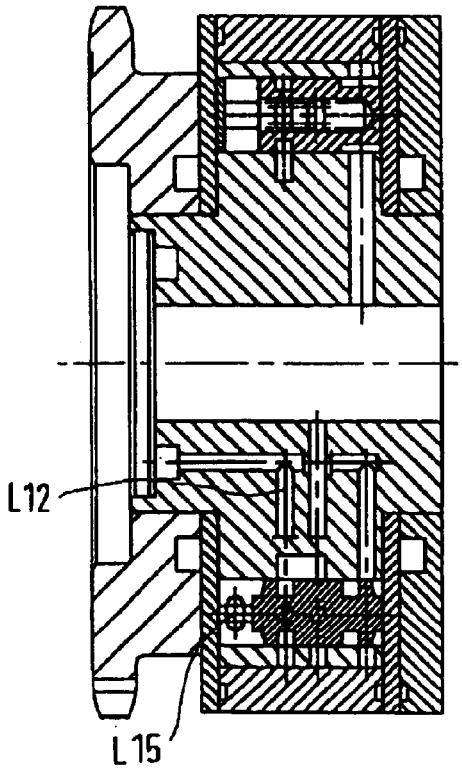
FIG. 3*c* is a view similar to FIG. 1*c,* shown in the third operational state depicted in FIG. 3*a;*
Figure 3D:
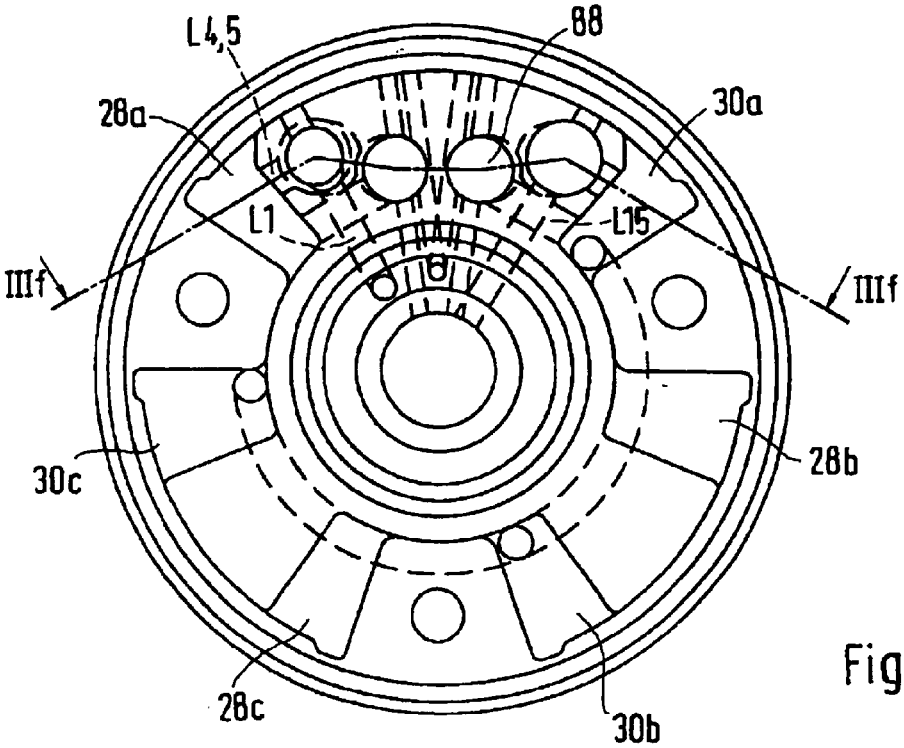
FIG. 3*d* is a view similar to FIG. 1*d,* shown in the third operational state depicted in FIG. 3*a;*
Figure 3E:
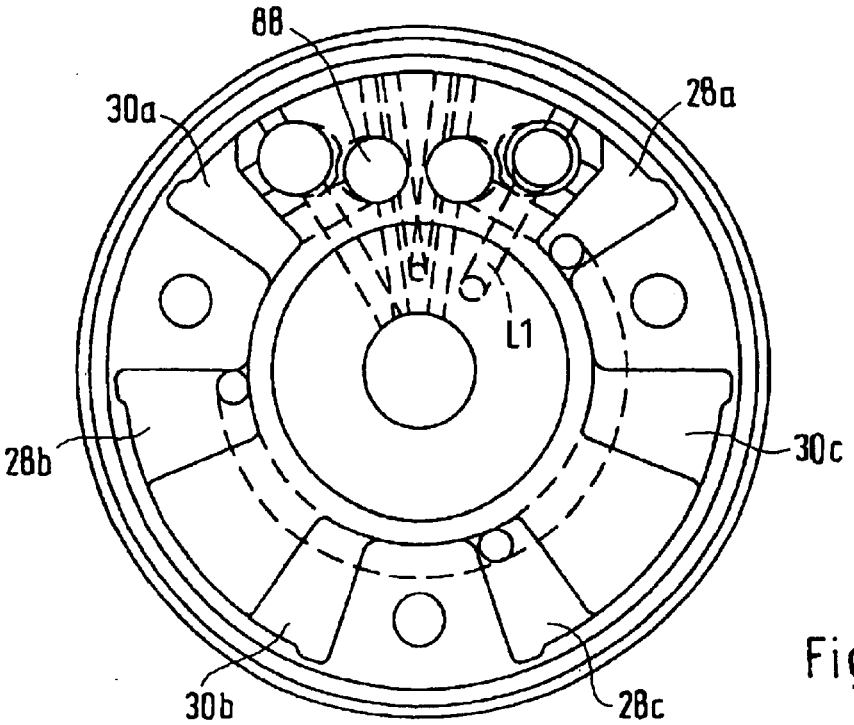
FIG. 3*e* is a view similar to FIG. 1*e,* shown in the third operational state depicted in FIG. 3*a;*
Figure 3F:
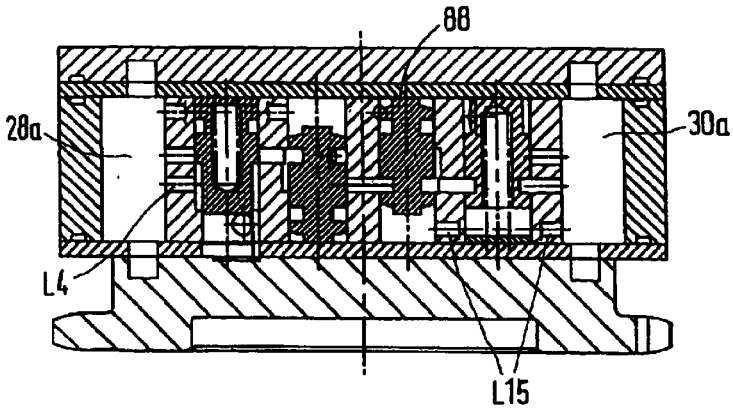
FIG. 3*f* is a view similar to FIG. 1*f,* shown in the third operational state depicted in FIG. 3*a;*
Figure 4A:
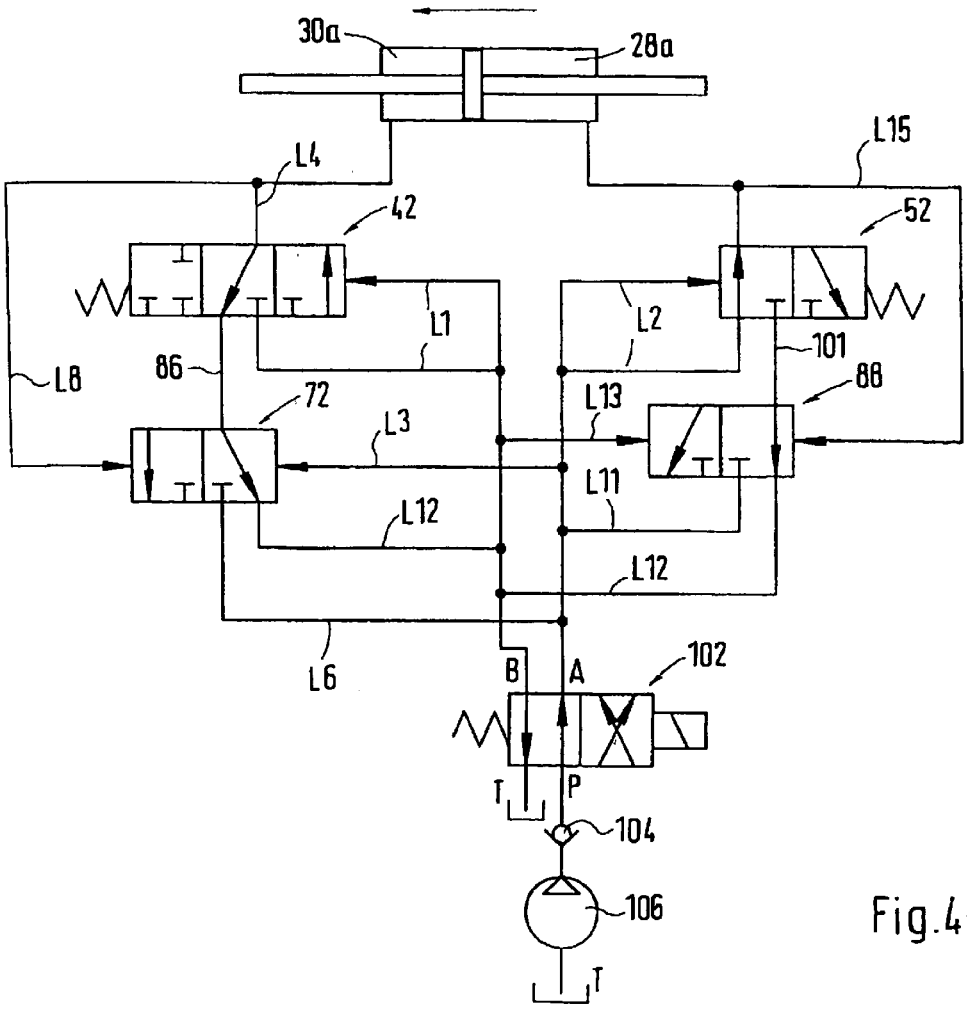
FIG. 4*a* is a view similar to FIG. 2*a,* shown in a fourth operational state.
Figure 4B:
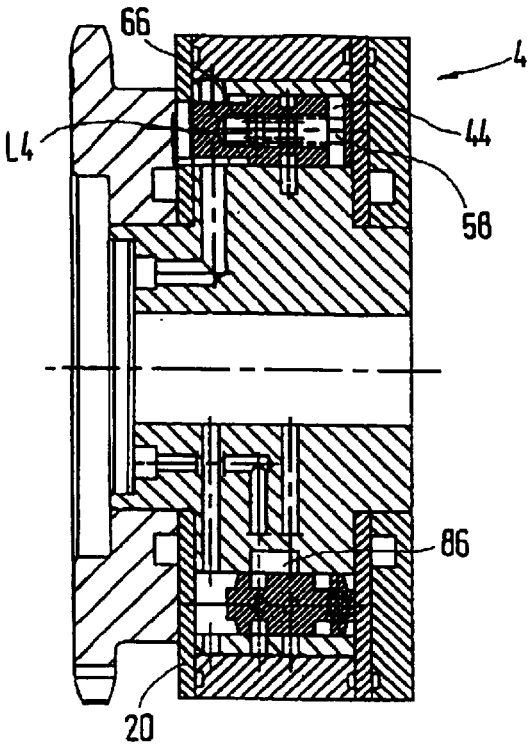
FIG. 4*b* is a view similar to FIG. 1*b,* shown in the fourth operational state depicted in FIG. 3*a;*
Figure 4C:
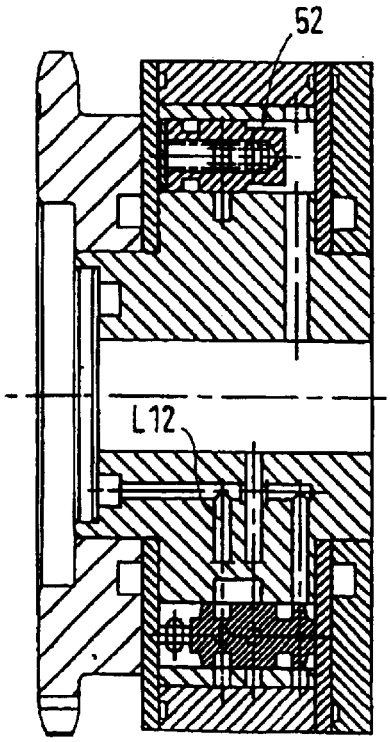
FIG. 4*c* is a view similar to FIG. 1*c,* shown in the fourth operational state depicted in FIG. 3*a;*
Figure 4D:
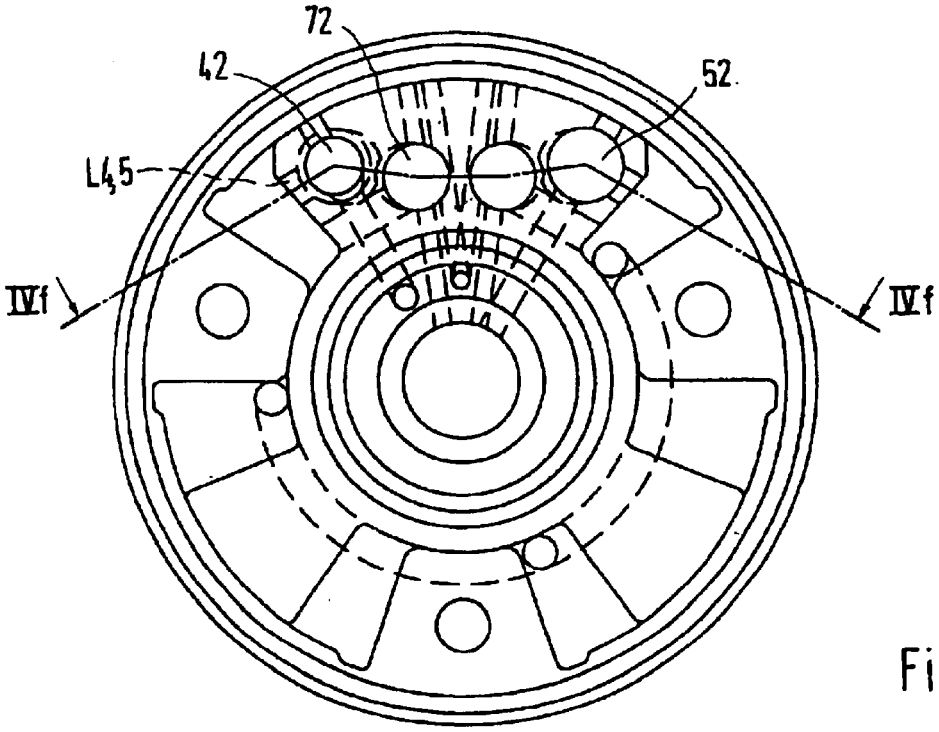
FIG. 4*d* is a view similar to FIG. 1*d,* shown in the fourth operational state depicted in FIG. 3*a;*
Figure 4E:
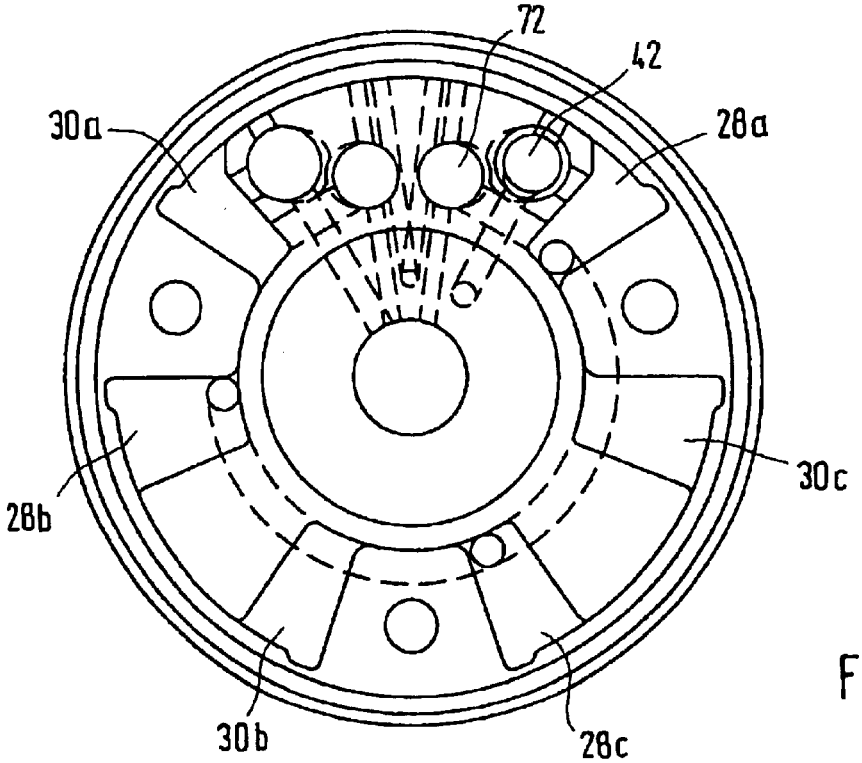
FIG. 4*e* is a view similar to FIG. 1*e,* shown in the fourth operational state depicted in FIG. 3*a;*
Figure 4F:
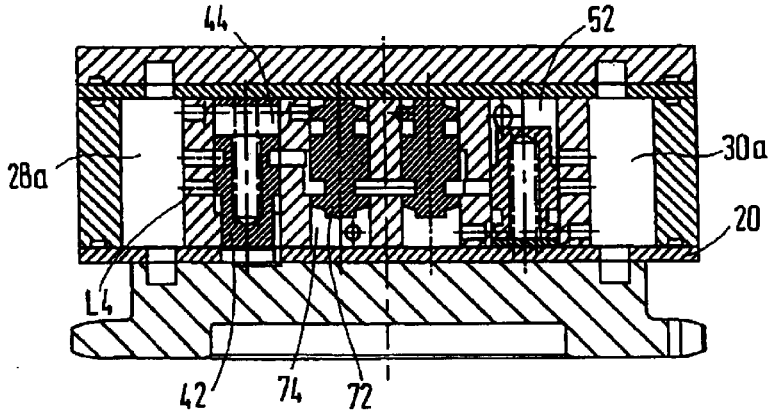
FIG. 4*f* is a view similar to FIG. 1*f,* shown in the fourth operational state depicted in FIG. 3*a;*
Figure 5A:
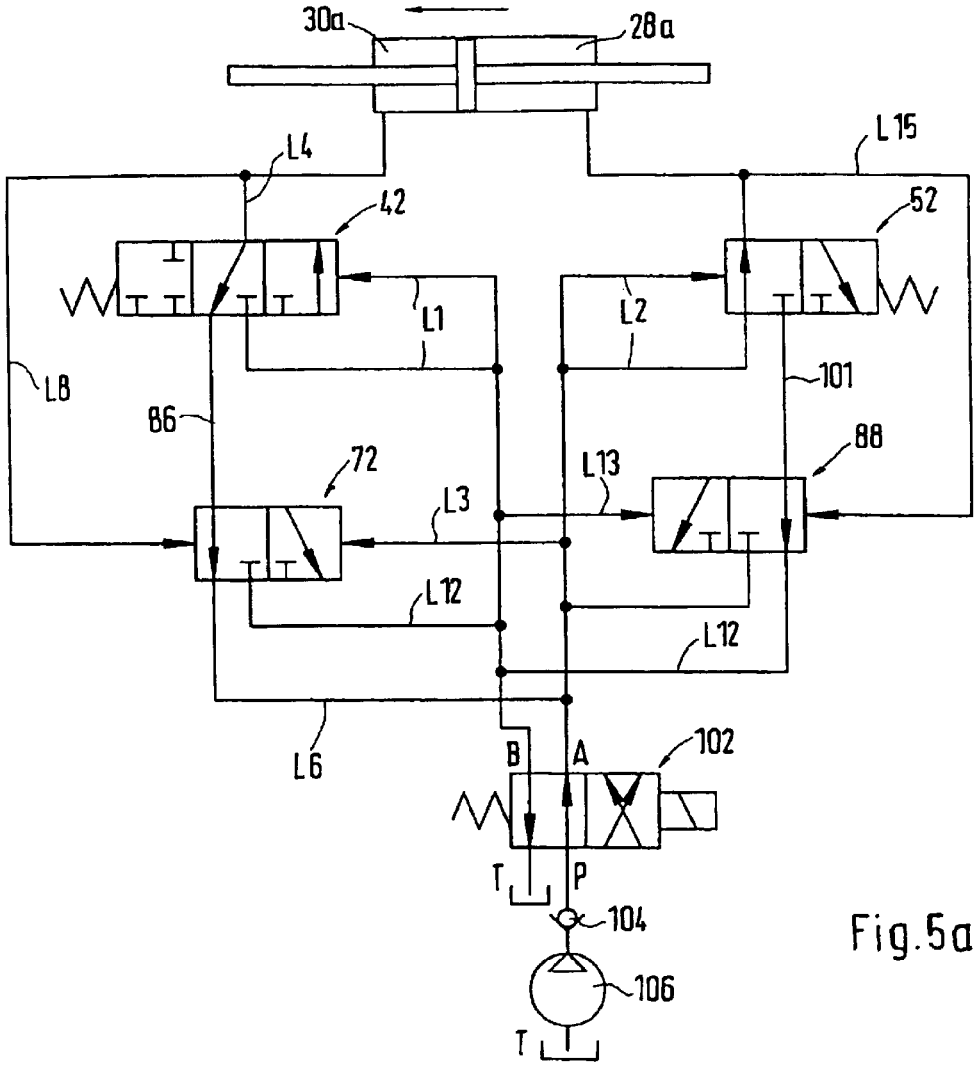
FIG. 5*a* is a view similar to FIG. 4*a,* shown in a fifth operational state.
Figure 5B:
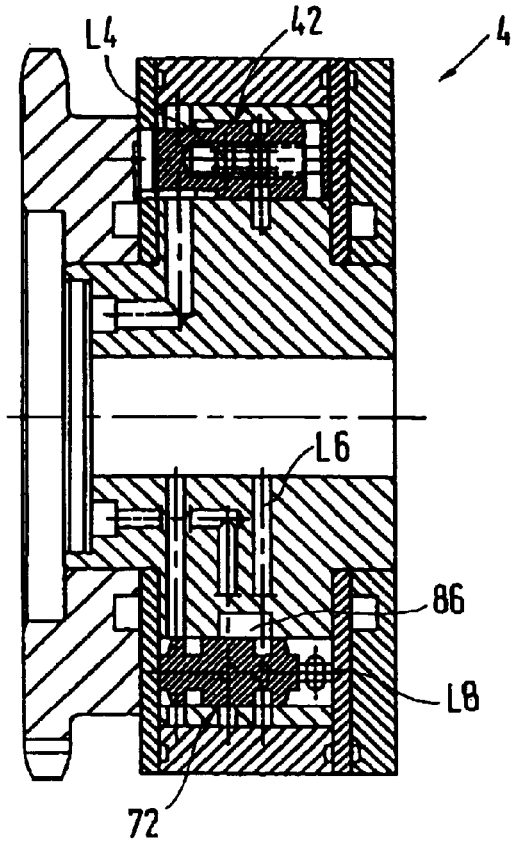
FIG. 5*b* is a view similar to FIG. 1*b,* shown in the fifth operational state depicted in FIG. 4*a;*
Figure 5C:
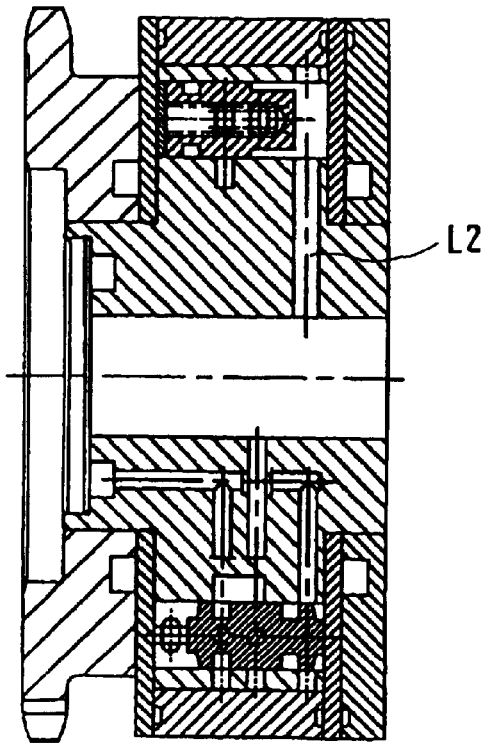
FIG. 5*c* is a view similar to FIG. 1*c,* shown in the fifth operational state depicted in FIG. 4*a;*
Figure 5D:
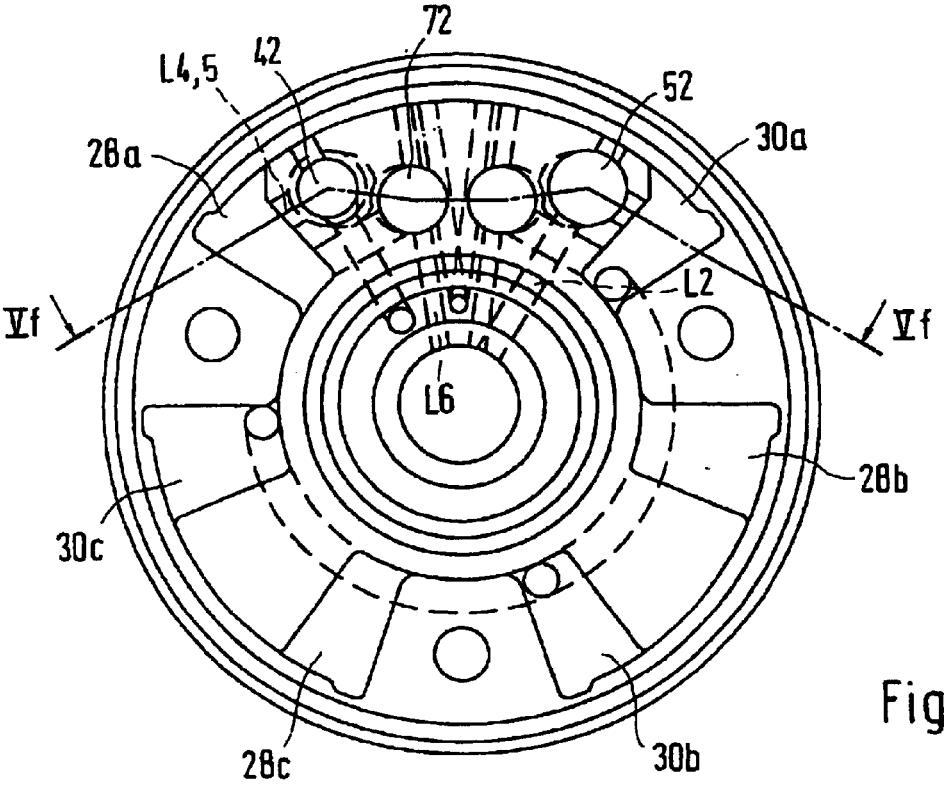
FIG. 5*d* is a view similar to FIG. 1*d,* shown in the fifth operational state depicted in FIG. 4*a;*
Figure 5E:
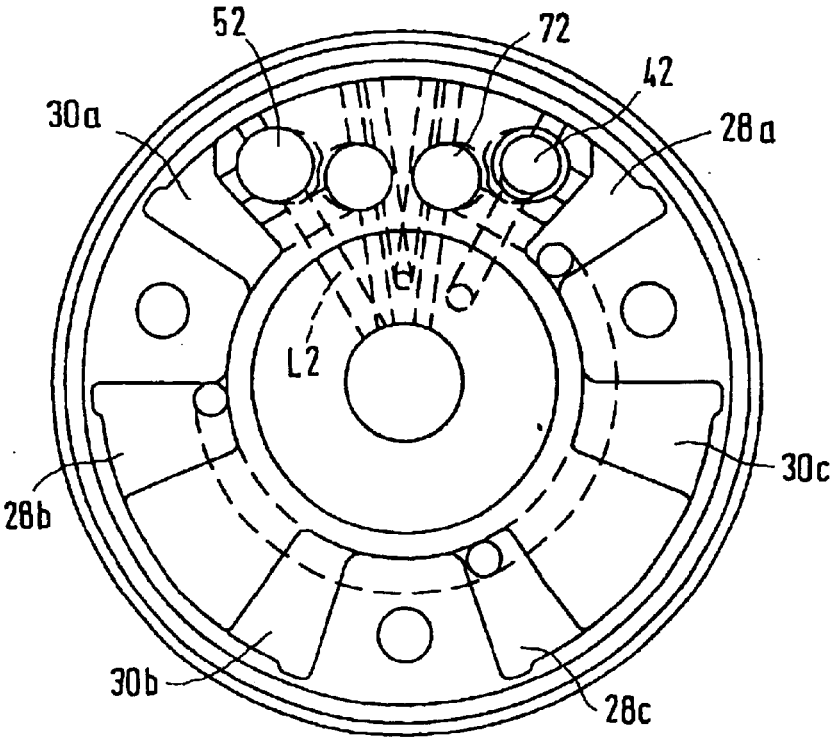
FIG. 5*e* is a view similar to FIG. 1*e,* shown in the fifth operational state depicted in FIG. 4*a;*
Figure 5F:
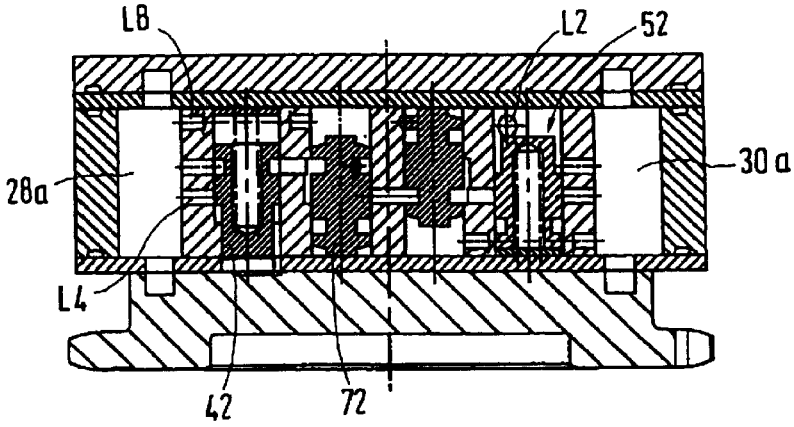
FIG. 5*f* is a view similar to FIG. 1*f,* shown in the fifth operational state depicted in FIG. 4*a;*
Figure 6A:
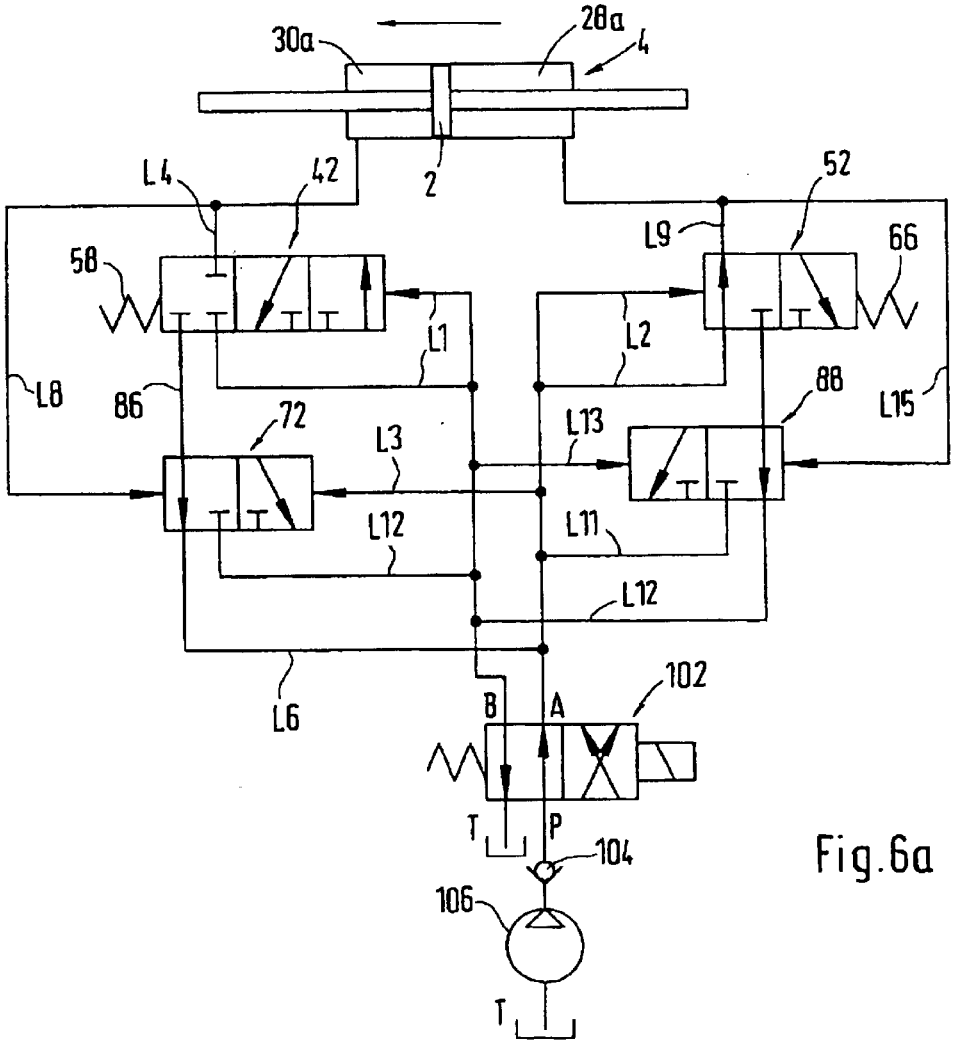
FIG. 6*a* is a view similar to FIG. 5*a,* shown in a sixth operational state.
Figure 6B:
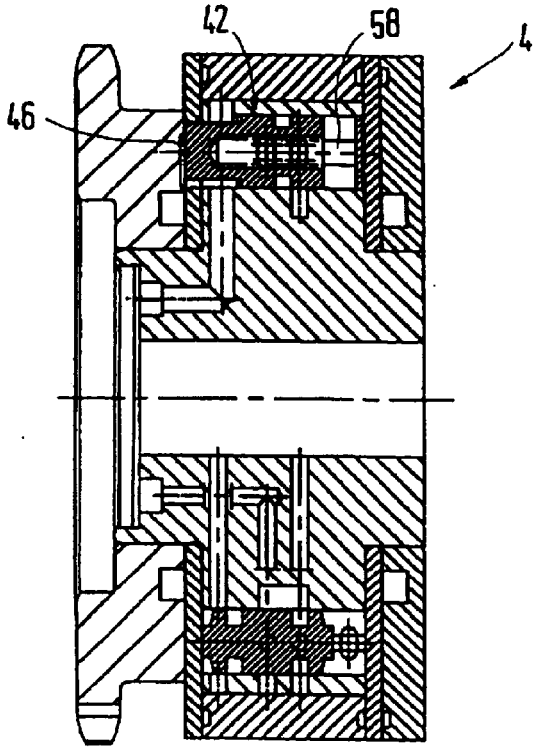
FIG. 6*b* is a view similar to FIG. 1*b,* shown in the sixth operational state depicted in FIG. 6*a;*
Figure 6C:
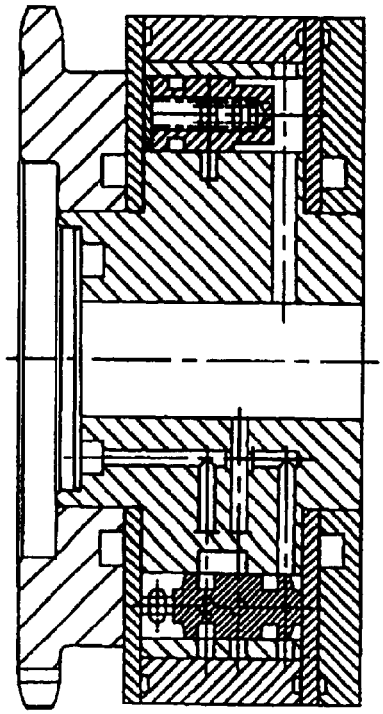
FIG. 6*c* is a view similar to FIG. 1*c,* shown in the sixth operational state depicted in FIG. 6*a;*
Figure 6D:
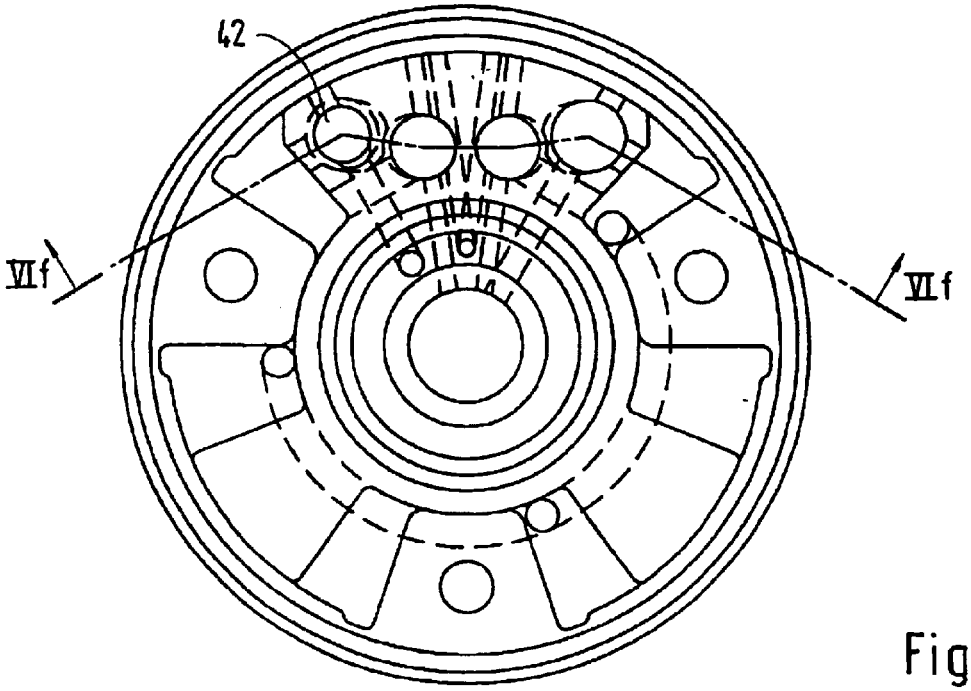
FIG. 6*d* is a view similar to FIG. 1*d,* shown in the sixth operational state depicted in FIG. 6*a;*
Figure 6E:
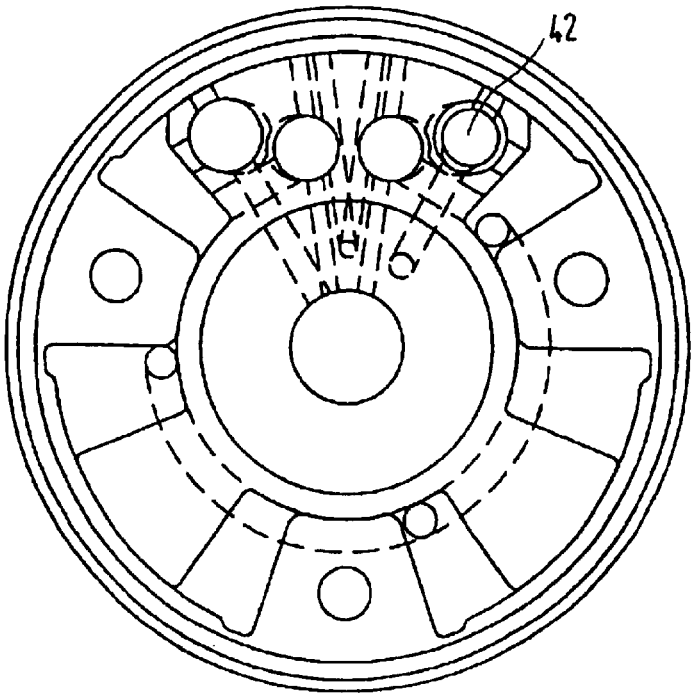
FIG. 6*e* is a view similar to FIG. 1*e,* shown in the sixth operational state depicted in FIG. 6*a;*
Figure 6F:
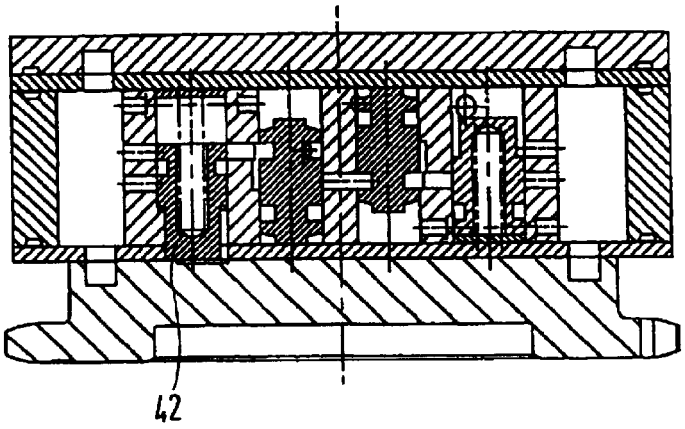
FIG. 6*f* is a view similar to FIG. 1*f,* shown in the sixth operational state depicted in FIG. 6*a;*

The locking pin 42 has an inner bore 56, in which a spiral spring 58 is taken up. The spiral spring 58 is supported at one end in the inner bore 56, which is designed as a blind hole bore, and at its other end against a plastic disc 60, which is adjacent to the second stationary seal ring 24. The locking pin 42 is forced by the spiral spring 58 into the opening 46 provided in the first stationary seal ring 20, so that the adjustment unit 4 is locked. On the outer circumference of the locking pin 42, an annular groove 62 is further provided, the function of which will be described in greater detail at a later point. The fixed member pin 52 is similar in design to the locking pin 42; it also has an inner bore 64, in which a spiral spring 66 is taken up between the end of the inner bore 64 and a plastic disc 68. The fixed member pin 52 also has an annular groove 70 located on its outer circumference. As is illustrated by way of example in FIG. 1*d* and FIG. 1*f,* to the right, next to the locking pin 42 in the vane 12*a* of the rotor 2, another valve pin 72 is provided, which is taken up in a bore 74. To provide a graphic representation that offers a greater overall view, the valve pin 72 was shown in FIGS. 1*b* through 6*b* in a mirrored position to the rotor axis; the actual position of the valve pin 72 is shown in FIGS. 1*d* through 1*f*. The valve pin 72 is equipped on its outer circumference with two annular grooves 76 and 78, the function of which also will be described in greater detail at a later point. From the annular chamber 54, a line L3 that extends radially in the fixed member 12*a* leads to the bore 74.

Further, two lines L4 and L5 are provided between the pressure chamber 28*a* and the bore 44 that holds the locking pin 42. This connection (line L4, 5) is controlled by the position of the locking pin 42. A second line L6 that extends radially away from the annular chamber 54 also leads to the bore 74, whereby the passageway is also controlled by the shiftable valve pin 72. A further line L7 provided in the vane 12*a* leads from the bore 74 to an annular groove 80 positioned in the hub 14, to which the line L1 that leads to the bore 44 of the locking pin 42 is also connected. Further, from the wall 81 that delimits the two bores 44 and 74, two sickle-shaped recesses 82 and 84 are formed, which, as is illustrated for example in FIG. 1*b,* form a common crossover area 86, whereby both recesses 82 and 84 are controlled by the locking pin 42 and the valve pin 72. Further, a line L8 leads from the bore 74 to the pressure chamber 28*a*.

The bore 50 that holds the fixed member pin 52 is connected to the pressure chamber 30*a* via two lines L9 and L10. In the fixed member 12*a* a further valve pin 88 is provided, which is taken up in a bore 90 such that it can shift. The valve pin 88 is equipped with two annular grooves 92 and 94 that extend along its outer circumference. The bore 90 is connected to the annular chamber 54 via a line L11 that extends radially in the fixed member 12*a*. In the wall fin 96 positioned between the two bores 50 and 90, once again two sickle-shaped recesses 98 and 100 that extend from the bores 50 and 90 are positioned, which intersect with one another in a common area 101; thus the two bores 50 and 90 are connected to one another, whereby the area 101 is controlled by the fixed member pin 52 and the valve pin 88. Lines L12 and L13 that lead away from the bore 90 empty into a line L14 that extends axially in the hub 14, with this line L14 itself being connected to the annular groove 80. A line L15 connects the bore 90 to the pressure chamber 30*a*.

The annular groove 54 is connected to an outlet-side connection A of a solenoid-controlled 4/2—distributing valve 102 via a line that is not illustrated here. The annular groove 80 is connected to a second outlet-side connection B of the solenoid valve 102 via a line that is not illustrated here. On the intake side, the solenoid valve 102 is equipped with a delivery connection P, which leads to an oil tank T via a check valve 104 and an oil pump 106. The oil tank T is, for example, the oil pan of an internal combustion engine, in which a corresponding oil pan is provided. The second intake-side connection of the solenoid valve 102 also leads to the oil tank T.

The process for changing the valve timing in an internal combustion engine using an adjustment unit 4 will now be described in greater detail below, with reference to the individual figures.

FIGS. 1*a*–1*f*: The solenoid valve 102 is unexposed to hydraulic flow, so that the oil is supplied by the oil pump 106 via the outlet A, the annular groove 54, and the line L2 to the fixed member pin 52. As a result of the hydraulic pressure acting against the fixed member pin 52, the fixed member pin 52 is shifted toward the left, and the line L9 that leads to the pressure chamber 28*a* is opened up. From the pressure chamber 28*a*, the oil is distributed via the annular channel 32 to the other two pressure chambers 28*b* and 28*c*. Because the line L15 is also loaded with oil via the line L9, the valve pin 88 is also moved from the right to the left (see FIG. 1*f*). Here, the locking pin 42 is in its right, final position, and is thus engaged in the bore 46.

FIGS. 2*a*–2*f*: The solenoid valve 102 is now exposed to hydraulic flow, thus initiating the adjustment process in the direction of the arrow shown in FIG. 2*a*. Via the outlet B of the solenoid valve 102, the hydraulic fluid flows via the annular groove 80, the line L1 to the locking pin 42, which it raises against the spring force or moves from the right to the left. Now the chamber 30*a* is supplied with hydraulic pressure via the line L4. Via the annular groove 36, the oil is also distributed to the two other pressure chambers 30*b* and 30*c*. The valve pin 72 is moved from the left to the right as a result of the pressure that is present in the line L8; the valve pin 88 is also loaded with hydraulic pressure via the line L13, so that this too is moved from the left to the right. Because in this position of the solenoid valve 102 the fixed member pin 52 is no longer exposed to hydraulic pressure, it is shifted by the spring 66 from the right to the left. As a result of the shifting movement of the rotor 2, the oil present in the pressure chambers 28*a* through 28*c* is returned to the oil tank T via the line L9, the fixed member pin 52, the valve pin 88, the area of intersection 101 of the two recesses 98 and 100, the valve pin 88, and the line L11.

FIGS. 3*a* to 3*f*: The operating position is the same as is shown in FIG. 2, i.e., the pressure chambers 30*a* through 30*c* are exposed to hydraulic fluid. In contrast with the position described in FIG. 2, with the closing of the intake or outlet valves, valve spring forces act against the trailing cams, so that a moment in the direction of adjustment, hereinafter referred to as moment of rotation, is transferred to the rotor 2 of the adjustment unit 4 that is fastened to the camshaft 6. In this manner, the hydraulic pressure in the pressure chambers 28*a* through 28*c* becomes greater than the pressure in the pressure chambers 30*a* through 30*c*, or at this moment the pressure in the pump line is less than the pressure in the pressure chambers 28*a* through 28*c*. The valve pin 88 is exposed to the hydraulic pressure present in the pressure chambers 28*a* through 28*c* via the line L15; it thus moves from the right to the left, so that the hydraulic flow that is forced out of the pressure chambers 28*a* through 28*c* is fed via the lines L12, L1 and L4 directly back to the pressure chambers 30*a* through 30*c*, avoiding the oil tank T. In order to prevent this hydraulic flow from draining off in the direction of the oil pump 106, the check valve 104 that is positioned in front of the solenoid valve 102 is closed. With the direct return of the partial hydraulic flow to the pressure chambers 30*a* through 30*c*, the adjustment speed of the camshaft adjustment unit 4 can be increased.

FIGS. 4*a* to 4*f*: It is assumed that the adjustment unit 4 has reached is maximum adjustment position, and must now be returned to its original starting position. To this end, the solenoid valve 102 is no longer exposed to hydraulic flow, so that the pressure intake P of the solenoid valve 102 switches back to the pressure-side outlet A. The fixed member pin 52 is forced by the pressure present in the line L2 against the spring 66 in its upper end position, i.e. from the left to the right, thus opening up the passage to the pressure chambers 28*a* through 28*c*. The locking pin 42 is moved by the spring force of the spring 58 into an intermediate position, which is determined by its position against the stationary seal ring 20 on the side of the sprocket. The valve pin 72 is also moved from the right to the left, so that the oil that is forced out of the pressure chambers 30*a* through 30*c* flows back to the oil tank T via the line L4, the locking pin 42, the area of intersection 86 of the two bores 44 and 74, the valve pin 72, and the line L12.

FIGS. 5*a* to 5*f*: Similar to the operating position described in FIGS. 3*a* to 3*f*, due to the compounding of the moment in the direction of movement of the adjustment unit 4, the pressure in the pressure chambers 30*a* through 30*c* increases, thus exceeding the hydraulic pressure present in the pressure chambers 28*a* through 28*c*. The hydraulic pressure prevailing in the pressure chambers 30*a* though 30*c* is transferred via the line L8 to the valve pin 72, which as a result is moved from the left to the right, thus opening up the passage to the hydraulic flow from the pressure chambers 30*a* through 30*c* to the delivery line, via the line L4, the locking pin 42, the area of intersection 86 and the line L6, so that this hydraulic flow can be fed directly back to the pressurized pressure chambers 28*a* through 28*c* via the line L2 and the fixed member pin 52, avoiding the oil tank T. In order to prevent this hydraulic flow from draining off in the direction of the oil pump 106, the check valve 104 is closed. By feeding the oil that flows out of the pressure chambers 30*a* through 30*c* directly into the pressurized chambers 28*a* through 28*c*, the adjustment speed of the adjustment unit 4 can again be increased.

FIGS. 6*a*–6*f*: The adjustment unit 4 has once again reached its original starting position (see FIG. 1). The locking pin 42 is forced by the spring 58 into the locking bore 46.

Figure 7A:
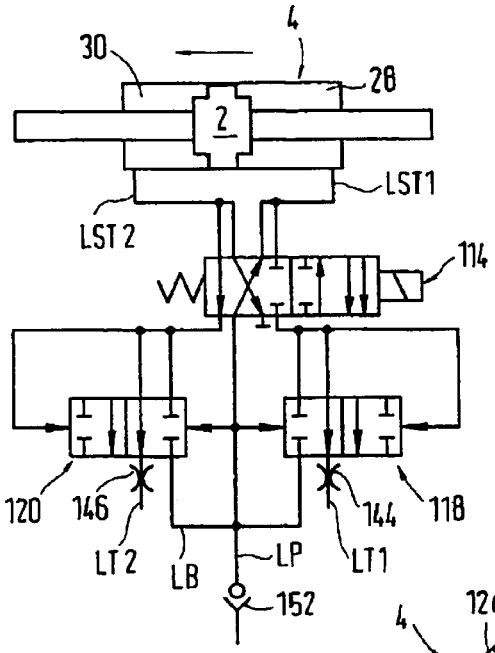
FIG. 7*a* is a hydraulic flow diagram for a camshaft adjuster constructed according to a second preferred embodiment of the invention.
Figure 7B:
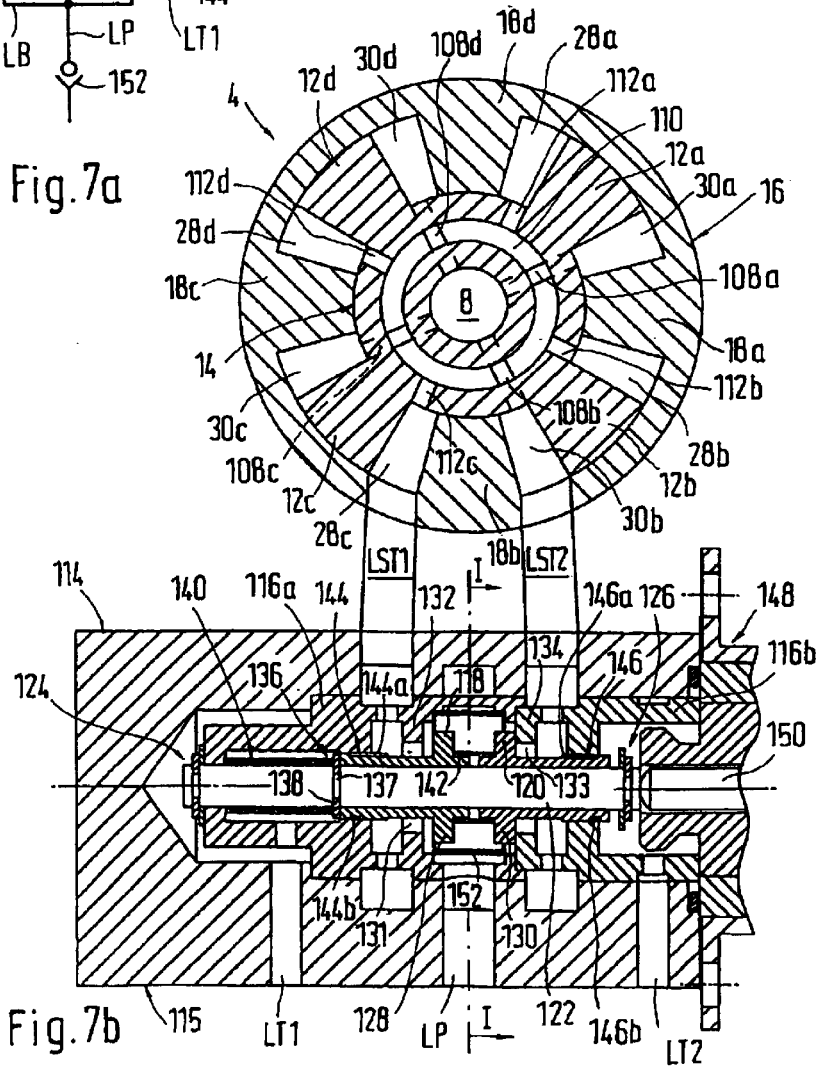
FIG. 7*b* is a sectional representation of a solenoid control valve for the embodiment of FIG. 7*a;*

With reference to FIGS. 7*a*, 7*b*; 8*a*, 8*b*, 9*a*, 9*b*, 10*a*, 10*b*, 11*a*, 11*b*, 12*a* and 12*b*, a second preferred embodiment will now be described, wherein once again the basic principle is applied of a bypass that is controlled by a valve element being provided between the two pressure chambers that are arranged in the adjustment unit of the camshaft adjuster. For this reason, in the second preferred embodiment only those characterizing features of the adjustment unit 4 of the camshaft adjuster that are essential to an explanation of its functioning are represented in the drawing and described, wherein components that are identical or similar to those in the first exemplary design are given the same reference figures.

The hub 14 of the rotor 2 of the adjustment unit 4 again is equipped with radially extended vanes 12*a* through 12*d,* which in conjunction with the radial fixed members 18*a* through 18*d* of the cell wheel 16 and with the axial delimiters (stationary seal rings) of the adjustment unit 4 form two pressure chambers 28*a* through 28*d* or 30*a* through 30*d* for adjusting the rotor 2 relative to the cell wheel 16. In the hub 14 of the rotor 2 a central bore 8 is again provided, which is connected via radially extended bores 108*a* through 108*d* to the pressure chambers 30*a* through 30*d.* An annular groove 110 provided in the hub 14 is connected via radial bores 112*a* through 112*d* to the pressure chambers 28*a* through 28*d.* A first control line LST1, illustrated only schematically here, is connected on one side with the annular groove 110, while the other side of the control line LST1 leads to an outlet-side connection of a solenoid valve 114. A second control line LST2 is connected to the central bore 8 that is provided in the hub 14, while on the other side it leads to a second outlet-side connection to the solenoid valve 114.

The construction of the solenoid valve 114 will be described below in greater detail. On the intake side, the solenoid valve 114 is equipped with two lines LT1 and LT2 that lead to an oil tank that is not illustrated here, and with a delivery line LP that leads to an oil pump that is not illustrated here. In the housing 115 for the solenoid valve 114, a two-part, cylindrical insert 116*a,* 116*b* is taken up, in which various hydraulic passageways are formed in conjunction with valve actuators 118 and 120, which will be described in greater detail below. In the cylindrical insert 116, a central bore is provided, in which a valve pin 122 is held. The valve pin 122 is held in the cylindrical insert 116 such that it can be shifted, whereby a left-justified and a right-justified stop-motion device 124 and 126 limit the possible axial adjustment of the valve pin 122. The two valve actuators 118, 120 are mounted on the valve pin 122, and are also directed such that they can be axially shifted on this pin. Each of the two valve actuators 118, 120 is equipped with a ring collar 128 and 130, which, in conjunction with wall sections 132 and 134 provided in the insert component, limit the possible axial shift of each of the two valve actuators 118, 120 in one direction. In this, the ring collars 128 and 130 monitor or control openings 131, 133 that produce a connection between the delivery line LP and the control lines LST1 and LST2. A further stop-motion device 136 for the valve actuator 118 is provided on the valve pin 122, which, like the two stop-motion devices 124, 126, is designed in the form of a snap ring 138 that is inserted into an annular groove 137. Further, between the snap ring 138 and the end of the cylindrical insert 116 that is closest to the housing, a spiral spring 140 is taken up coaxially to the valve pin 122, wherein this spring, as is shown in FIG. 7*b,* forces the valve actuator 118 into the position shown here when the solenoid valve 114 is not exposed to hydraulic flow; the stop-motion device 124 limits this position of adjustment. Between the two ring collars 128, 130 of the valve actuator 118, 120 a second spiral spring 142 is supported, which shifts the valve actuator 120 into the position shown in FIG. 7*b,* with the wall section 134 of the cylindrical insert 116 serving as the stop-motion device. Both the valve actuator 118 and the valve actuator 120 are equipped with a choke gap 144 and 146, which, depending upon the position of the valve actuator 118, 120, connects the control line LST1 or LST2 to the tank line LT1 or LT2. In this, the choke gaps 144, 146 are designed in the form of an axial groove 144*a,* 146*a* and an annular groove 144*b* and 146*b* that is connected to the axial groove 144*a,* 146*a.*

The valve housing 114 is flange-mounted laterally on an electrical housing component 148, in which, in a known manner, a tappet 150 that is capable of shifting axially is held, and is enclosed within a magnet and a coil. The tappet 150 is aligned axially relative to the valve pin 122, and thus is capable of shifting the valve pin 122 axially, depending upon the flow against the solenoid valve.

Figure 14:
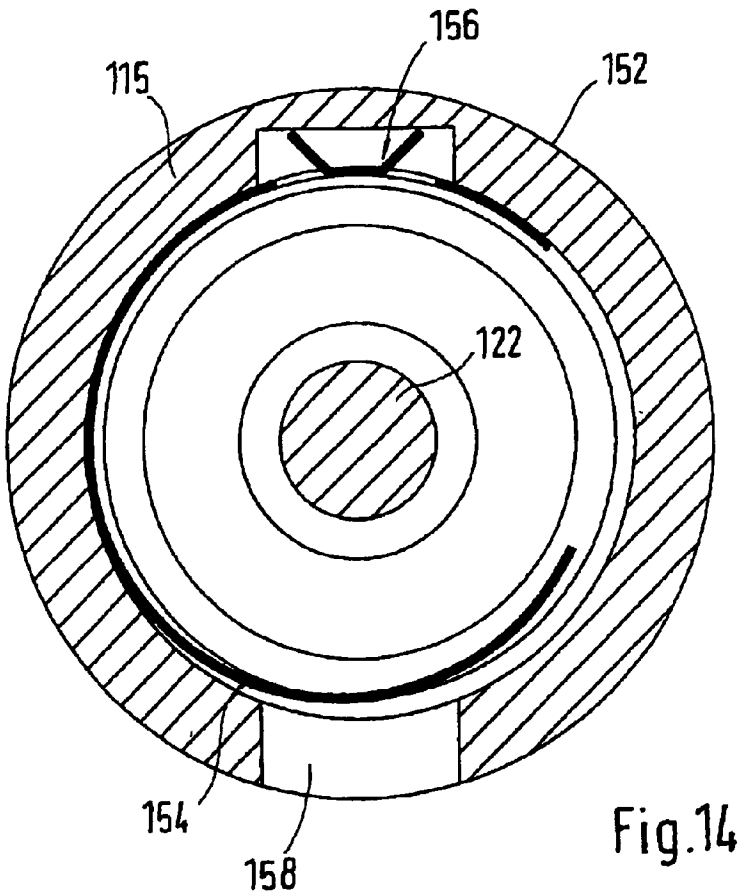
FIG. 14 is a view of the check valve of FIG. 13 shown in an opened position.
Figure 13:
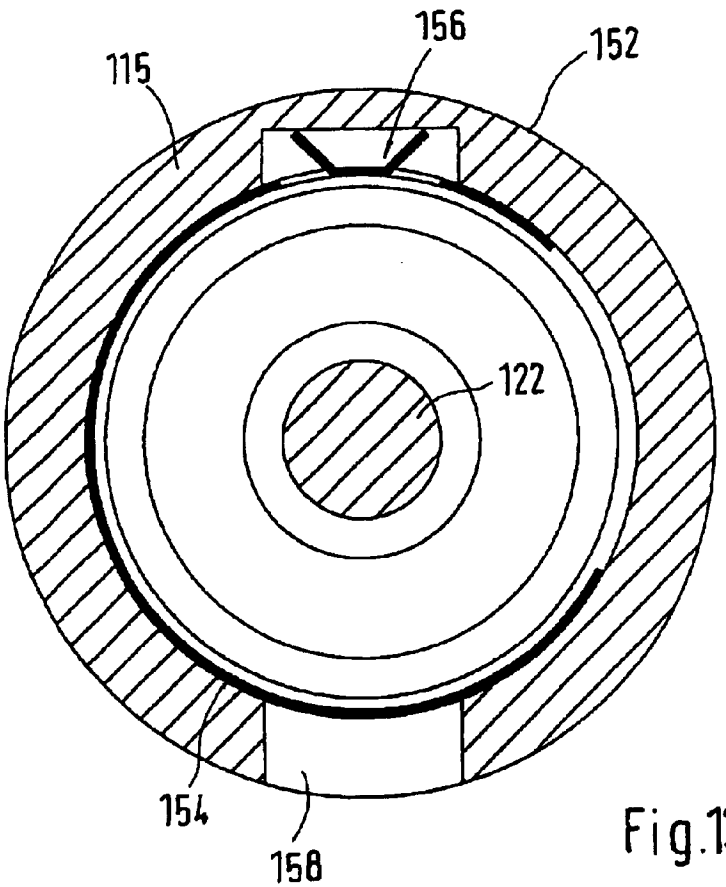
FIG. 13 is an enlarged sectional representation along the line I—I in FIG. 7*b* of a check valve positioned in a delivery line, shown in a closed position.

In the delivery line LP, a check valve 152 is further arranged, which in FIGS. 13 and 14 is illustrated, enlarged, in a closed and in an opened position. The valve body of the check valve 152 is designed as a spring band 154, which is mounted on a section of the housing wall 156 and at its free end controls the opening 158 of the delivery line LP.

Below, the functioning of the second preferred embodiment will be described in greater detail with reference to the drawings:

FIGS. 7*a,* 7*b:* The solenoid valve 114 is not exposed to hydraulic flow; via the delivery line LP, the opening 131 that is opened up by the ring collar 128 of the valve actuator 118, and the control line LST1, the pressure chambers 28*a* through 28*d* are loaded with oil. The rotor 2 of the adjustment unit 4 is moved in the direction indicated by the arrow in FIG. 7*a.* The oil forced out of the pressure chambers 30*a* through 30*d* is returned to the oil tank T via the control line LST2 and the choke gap 146, and via the oil tank line LT2.

Figure 8A:
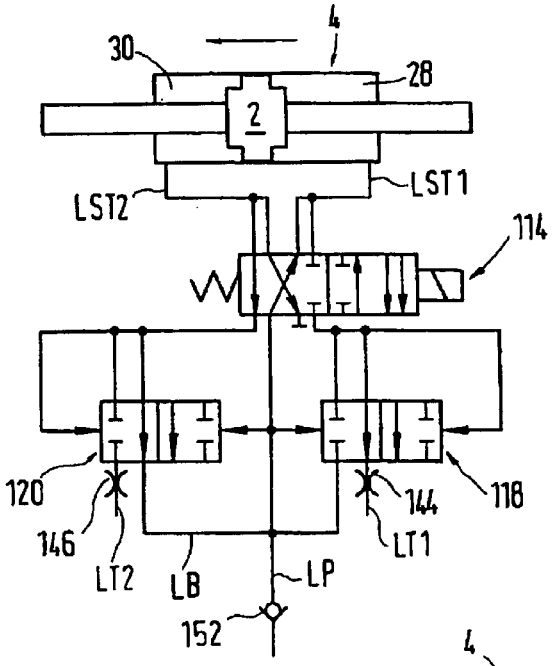
FIG. 8*a* is a hydraulic flow diagram for the arrangement of FIGS. 7*a* and 7*b,* shown in a second operational state.
Figure 8B:
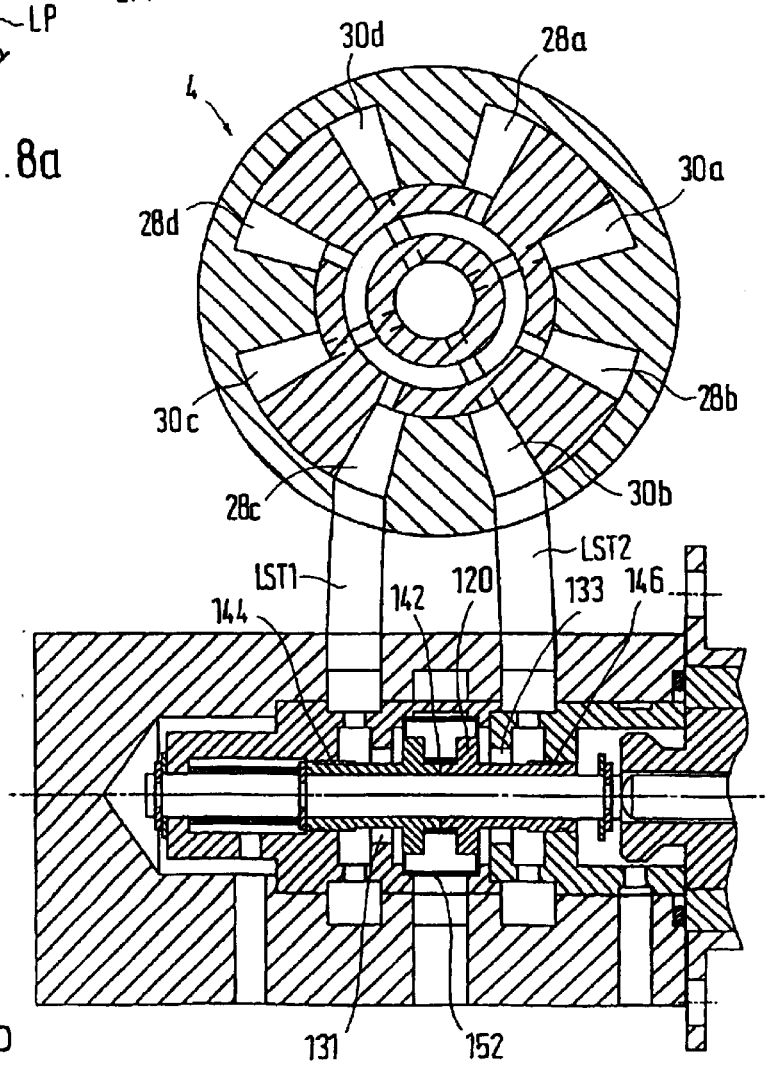
FIG. 8*b* is a view similar to FIG. 7*b,* shown in the second operational state depicted in FIG. 8*a;*

FIGS. 8*a,* 8*b:* In the direction of the adjustment movement, as has already been described in detail with reference to the first exemplary design, a moment of rotation is transferred via the cams of the camshaft to the rotor 2, on the basis of which the hydraulic pressure in the pressure chambers 30*a* through 30*d* exceeds the hydraulic pressure in the pressure chambers 28*a* through 28*d.* The hydraulic pressure prevailing in the pressure chambers 30 is transferred to the valve actuator 120 via the control line LST2; via the ring collar 130 and against the force of the spring 142, the valve actuator 120 is shifted into the position shown in FIG. 8*b.* In this manner, both of the openings 131 and 133 that are controlled by the ring collars 128, 130 are opened up, so that the oil can be returned via the line LB directly to the control line LST1 that leads to the pressure chambers 28. The choke gaps 144 and 146 are closed, so that no oil can flow out via the oil tank lines LT1 and LT2. The check valve 152 positioned in the delivery line LP is also sealed.

Figure 9A:
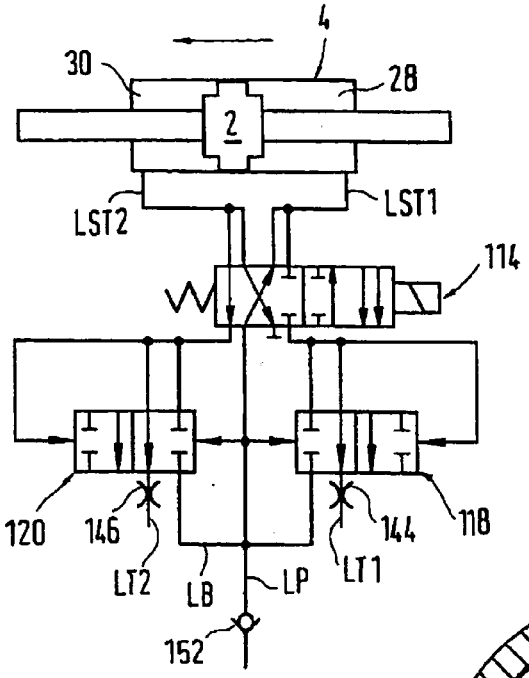
FIG. 9*a* is a hydraulic flow diagram for the arrangement of FIGS. 7*a* and 7*b,* shown in a third operational state.
Figure 9B:
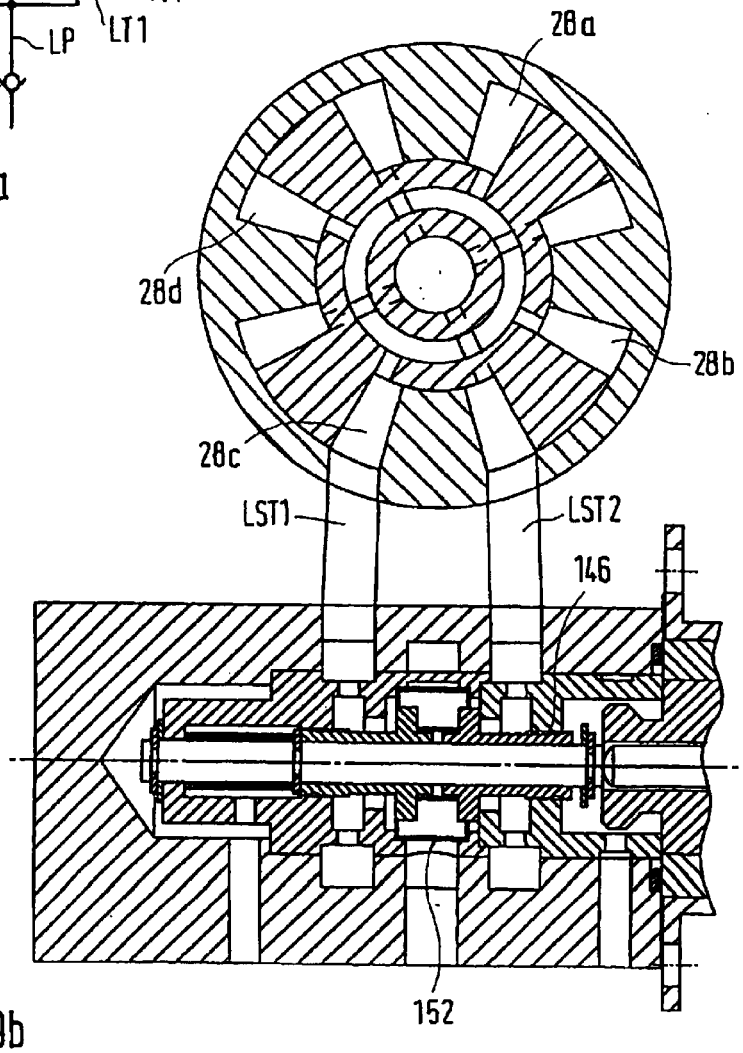
FIG. 9*b* is a via similar to FIG. 7*b,* shown in the third operational state depicted in FIG. 9*a;*

FIGS. 9*a,* 9*b:* The pressure chambers 28*a* through 28*d* are further loaded with oil via the control line LST1, however, a degree of moment that acts against the motion of adjustment (moment of counter-rotation) causes the pressure in the pressure chambers 28*a* through 28*d* to be greater than the pressure in the feed line LP. In this operating position, no adjustment takes place and the check valve 152 assumes its closed position, in which it performs a support function. The control line LST2 is pressureless, since the connection to the tank line LT2 has been opened via the choke gap 146.

Figure 10A:
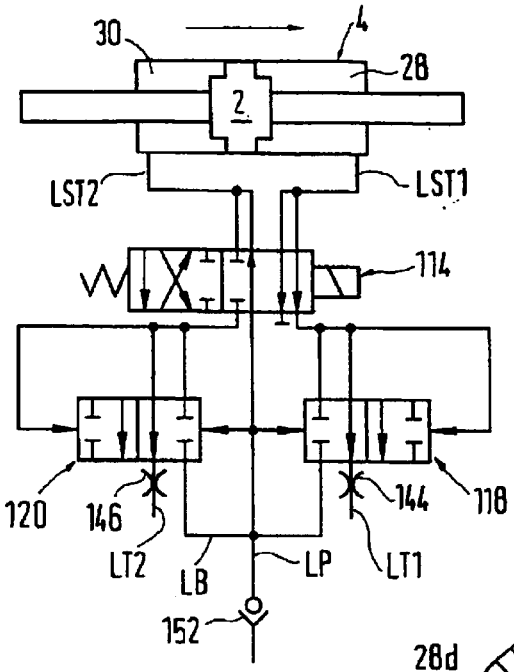
FIG. 10*a* is a hydraulic flow diagram for the arrangement of FIGS. 7*a* and 7*b,* shown in a fourth operational state.
Figure 10B:
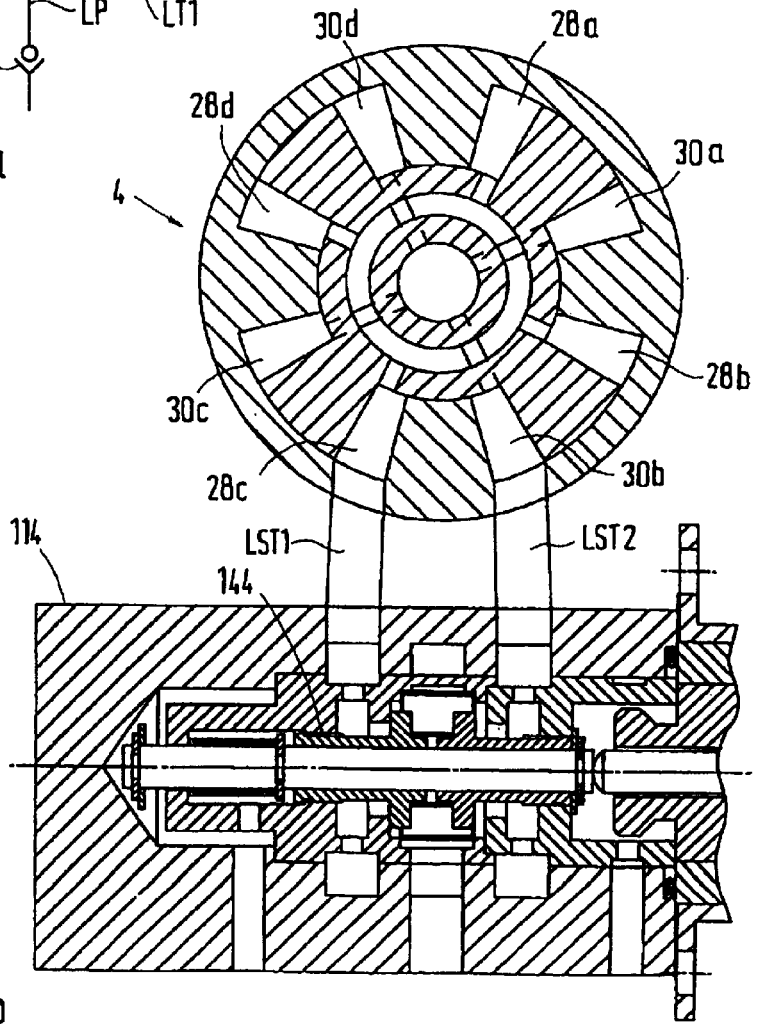
FIG. 10*b* is a view similar to FIG. 7*b,* shown in the fourth operational state depicted in FIG. 10*a;*

FIGS. 10*a,* 10*b:* The adjustment unit 4 has reached its maximum adjustment position, and will now be adjusted to return in the direction of its original starting position. To this end, the solenoid valve 114 is exposed to hydraulic flow, so that the hydraulic fluid reaches the pressure chambers 30*a* through 30*d* via the delivery line LP and the control line LST2. In this manner, the rotor 2 of the adjustment unit 4 is shifted in the direction indicated by the arrow. The hydraulic fluid that is forced out of the pressure chambers 28*a* through

28*d* is returned via the control line LST1 and via the opened choke gap 144 into the oil tank line LT1, and thus to the oil tank T.

Figure 11A:
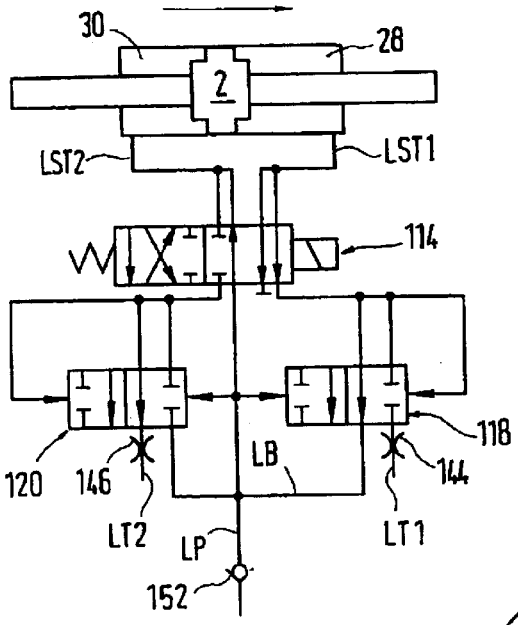
FIG. 11*a* is a hydraulic flow diagram for the arrangement of FIGS. 7*a* and 7*b,* shown in a fifth operational state.
Figure 11B:
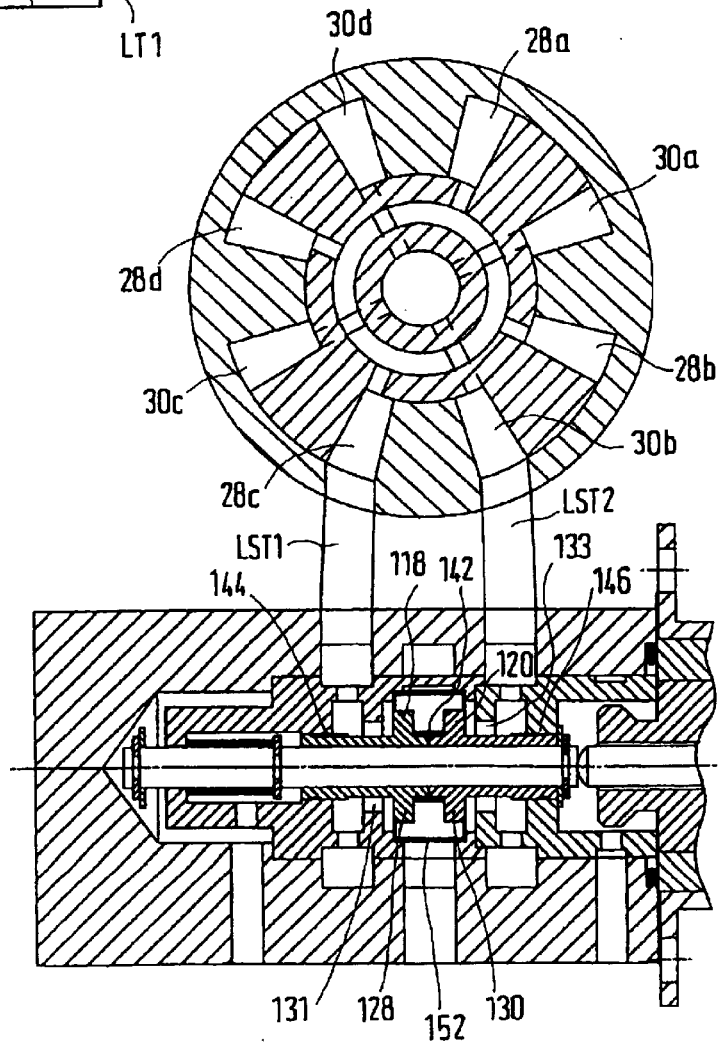
FIG. 11*b* is a view similar to FIG. 7*b,* shown in the fifth operational state depicted in FIG. 11*a;*

FIGS. 11*a,* 11*b:* To initiate the adjustment motion, a moment of rotation is again exceeded, so that the pressure that is present in the pressure chambers 28*a* through 28*d* exceeds the pressure in the delivery line LP. In this manner, the valve actuator 118 is shifted against the force of the spring 142 via its ring collar 128, and into the position shown in FIG. 11*b*. In this manner, the two openings 131 and 133 that are controlled by the ring collars 128, 130 of the valve actuator 118, 120 are again opened up, and the two oil tank lines LT1 and LT2 are separated from the control lines LST1 and LST2 as a result of the closed choke gap 144, 146. In this manner, the oil that is flowing out of the pressure chambers 28*a* through 28*d* can be fed via the line LB directly to the control line LST2, and thus to the pressure chambers 30*a* through 30*d,* avoiding the oil tank T. In this operating position the check valve 152 is closed.

Figure 12A:
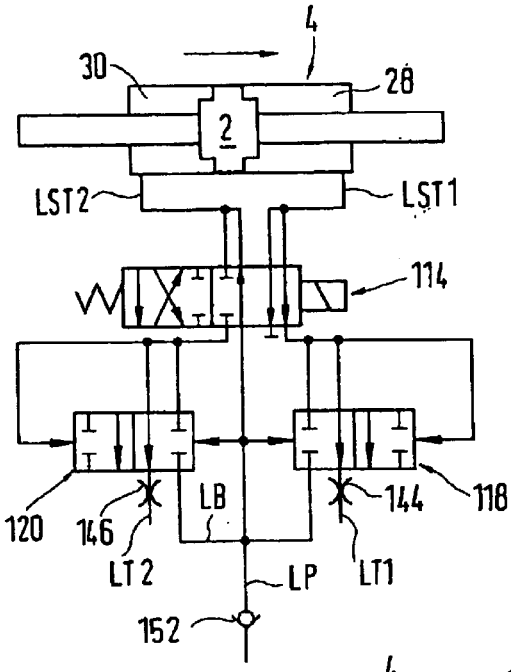
FIG. 12*a* is a hydraulic flow diagram for the arrangement of FIGS. 7*a* and 7*b,* shown in a sixth operational state.
Figure 12B:
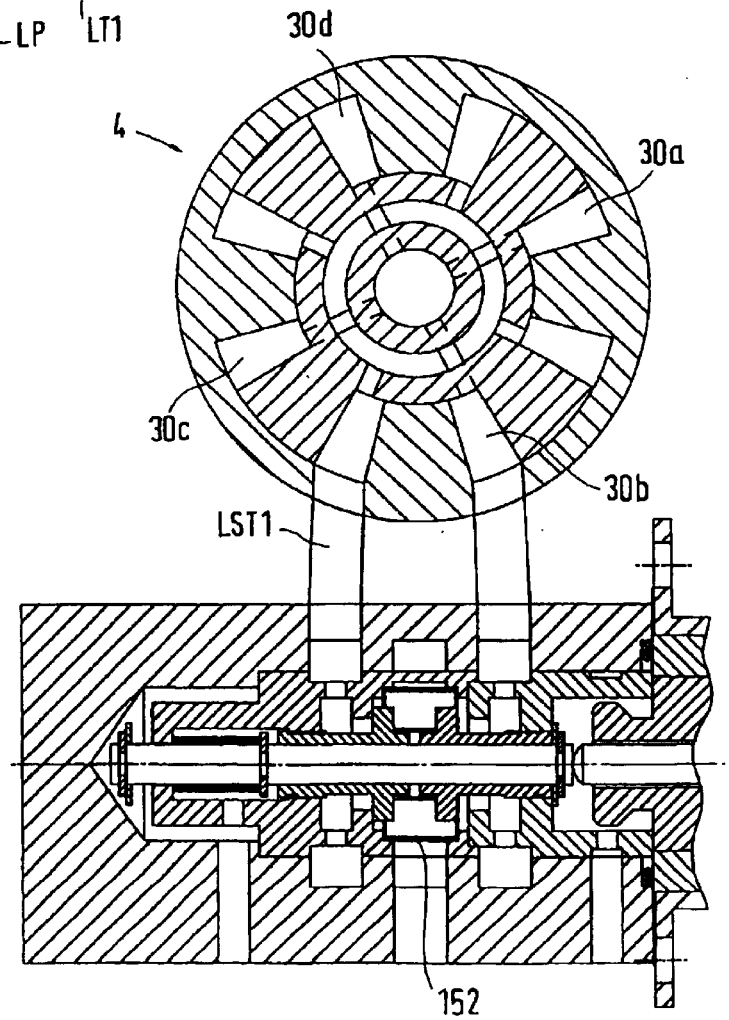
FIG. 12*b* is a view similar to FIG. 7*b,* shown in the sixth operational state depicted in FIG. 12*a;*

FIGS. 12*a,* 12*b:* The rotor 2 of the adjustment unit 4 is to be adjusted further in the direction of the original starting position; however, the pressure conditions are reversed due to a moment of counter-rotation (caused by the opening of the intake or outlet valves via the leading cams against the spring force of the valves), such that the pressure in the pressure chambers 30*a* through 30*d* exceeds the pressure in the delivery line LP. In this case, no adjustment motion takes place; the check valve 152 is closed, causing it to take on a support function, while the control line LST1 is pressureless, since the choke gap 144 that leads to the tank line LT1 is opened. Upon completion of the adjustment process, the adjustment unit has returned to its original starting position.

FIGS. 13 and 14 are enlarged representations shown along line I—I of FIG. 7*b,* showing the check valve in respective closed and open positions.

Figure 15:
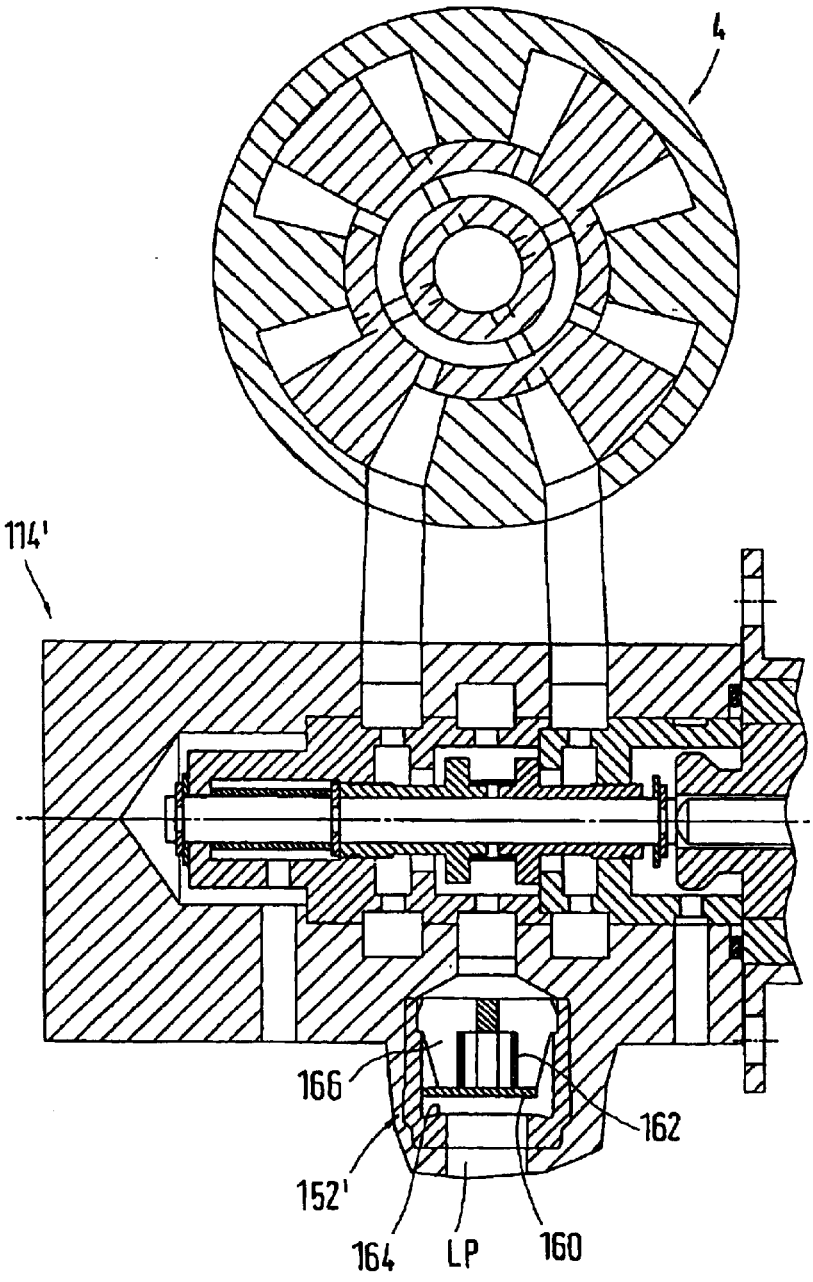
FIG. 15 is a sectional representation of a modified solenoid control valve with a shifted check valve for use in the embodiment of FIGS. 7*a* and 7*b;*

The solenoid valve 114' shown in FIG. 15, which here has assumed a position that corresponds to the one in FIG. 7*b,* differs from the solenoid valve 114 only in that a check valve 152' in an altered form is integrated into the delivery line LP. The check valve 152' has as its valve body a plate element 160, which, when the line LP is pressureless, is forced by a spring element against a first valve seat 164, thus closing the line LP. When the check valve 152' is open, the plate element 160 is forced against a stop-motion surface of an insert 166, and the oil delivery line LP is opened up.

Figure 16B:
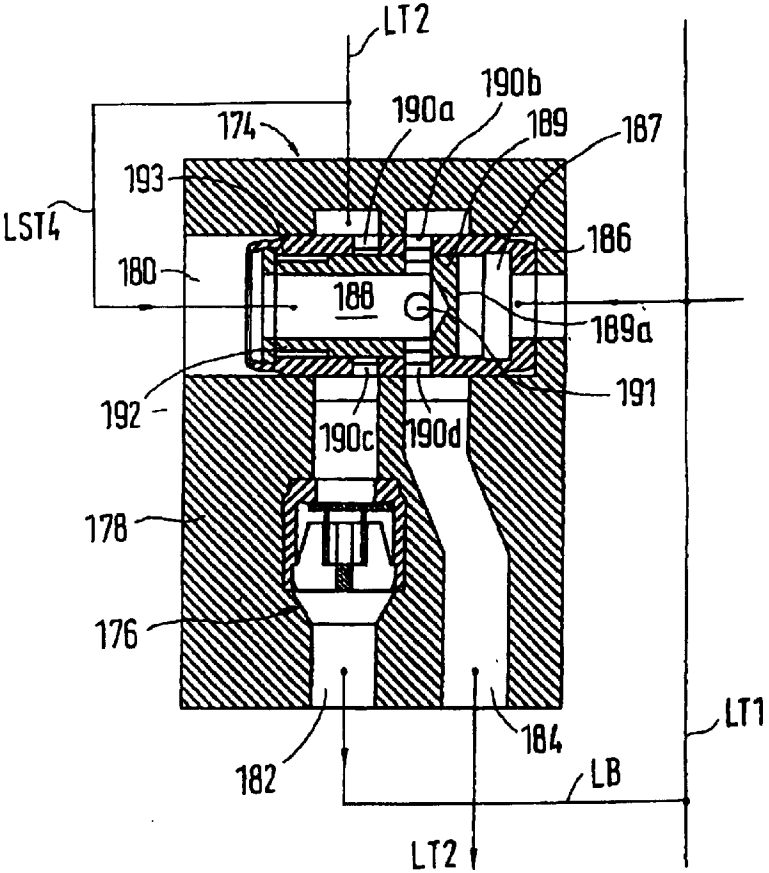
FIG. 16*b* is a sectional representation of a control valve according to the third preferred embodiment of FIG. 16*a;*
Figure 16A:
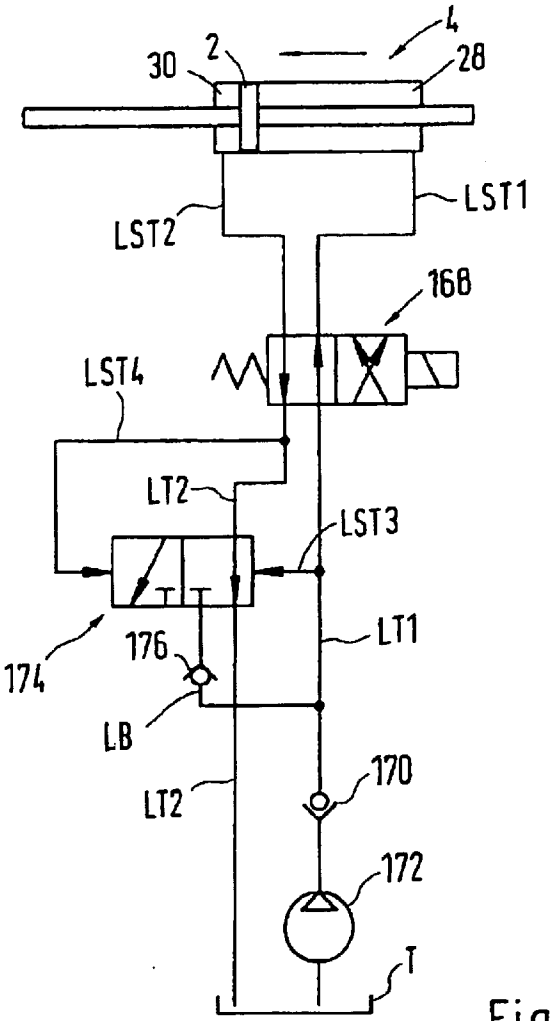
FIG. 16*a* is a hydraulic flow diagram for a camshaft adjuster constructed according to a third preferred embodiments of the invention.
Figure 17B:
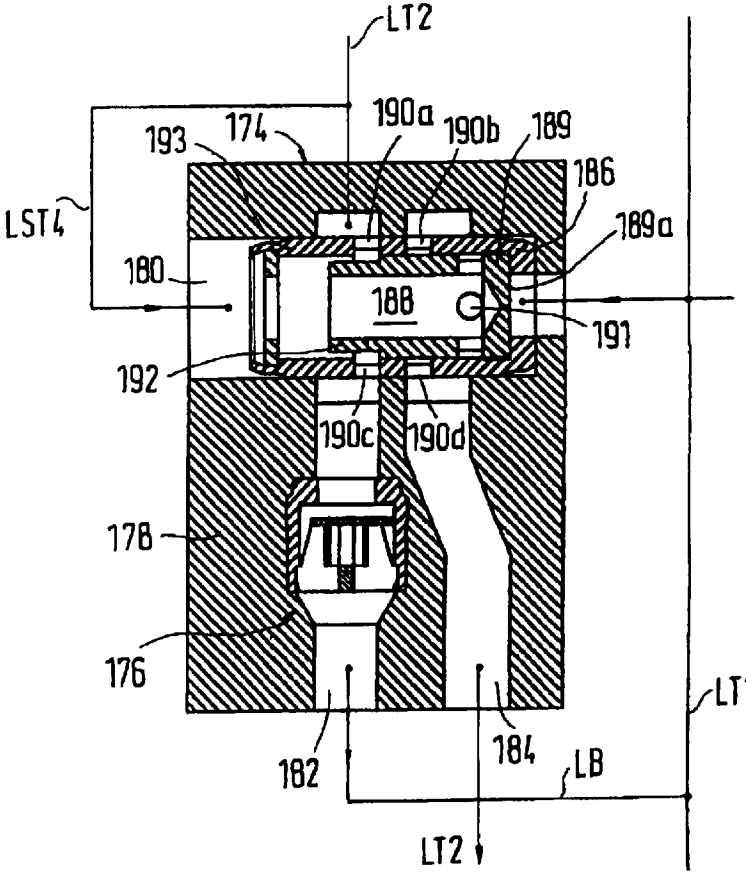
FIG. 17*b* is a view similar to FIG. 16*b,* shown in the second operation state depicted in FIG. 17*a.*

A third and final preferred embodiment is represented in FIGS. 16 and 17, and is described in greater detail below. For purposes of simplicity, only an adjustment device is depicted and described in FIGS. 16 and 17, wherein these drawings differ in that according to FIG. 17 an additional force of adjustment in the direction of the motion of adjustment is generated as a result of the moment of rotation. Here again, two control lines LST1 and LST2 lead to the two pressure chambers 28 and 30, which again are represented only schematically, with these two control lines being connected to two outlets of a solenoid valve 168. The solenoid valve 168 is designed as a 4/2 directional valve, and thus is equipped with two intakes, to which two lines that lead to an oil tank T, hereinafter referred to as LT1 and LT2, are connected. In the tank line LT1, again, a check valve 170 and an oil pump 172 are arranged. In the tank line LT2, a pressure-controlled 3/2 directional valve, hereinafter referred to as the switch 174, is positioned. An outlet of the switch 174 is connected to the oil tank line LT1 via a line LB, in which a further check valve 176 is arranged. The switch 174 is controlled by the pressure levels present in the oil tank lines LT1 and LT2. To this end, a control line LST3 branches off of the tank line LT1, and is connected to an intake of the switch 174; a control line LST4 branches off of the tank line LT2 and is connected to a further intake of the switch 174.

Before the functioning of this third preferred embodiment for camshaft adjustment is described in detail, the internal design of the switch 174 shall be described briefly below. The housing 178 of the switch 174 is equipped with a continuous cross-bore 180, to which two bores 182 and 184 extend crosswise. In the bore 182, the check valve 176 is integrated, whereby the bore 182 represents a component of the bypass line LB, which is connected to the tank line LT1. The bore 184 represents a component of the tank line LT2 that leads to the oil tank T. In the cross-bore 180 a tubular insert 186 is emplaced, in the hollow space 187 of which a tubular valve actuator 189 that is equipped with an inner bore 188 is taken up. The walls of the insert 186 are equipped with bores 190*a* through *d*, which may be opened or closed depending upon the position of the valve actuator 189. The valve actuator 189 is further equipped with a cross-bore 191 and a section 192, the outer diameter of which is tapered, on the basis of which a ring collar 193 is provided between the insert 186 and the valve actuator 189 in this area.

The third preferred embodiment functions as follows:

FIGS. 16*a,* 16*b:* If the solenoid valve is not exposed to hydraulic flow, then the flow of oil that is forced from the pump 172 is fed to the pressure chambers 28 via the tank line LT1 and the control line LST1. The oil present in the pressure chambers 30 flows via the control line LST2 and the switch 174 into the tank line LT2 and thus into the oil tank T. As is apparent from FIG. 16*b,* the valve actuator 189 assumes its left, stop-motion position as a result of the pressure acting against the end face 189*a* of the valve actuator 189, so that the oil can flow out via the bores 190*a,* 191 and 190*d* to the oil tank.

Figure 17A:
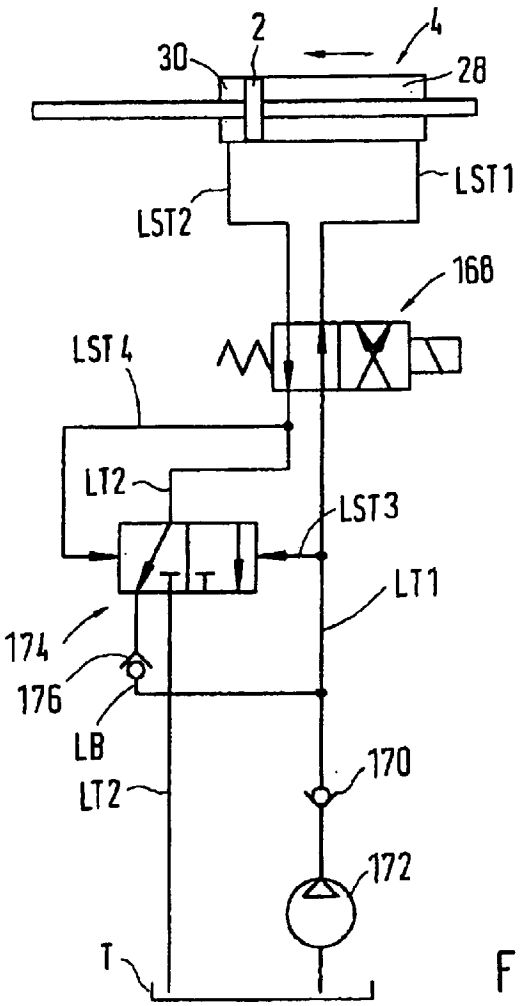
FIG. 17*a* is a hydraulic flow diagram for the arrangement of FIGS. 16*a* and 16*b,* showing a second operational state.

FIGS. 17*a,* 17*b:* If now, in addition to the adjustment motion, an additional moment of adjustment is applied to the rotor 2 of the adjustment unit 4 as a result of the moment of rotation, then the pressure present in the pressure chambers 30 exceeds the pressure present in the pressure chambers 28 and thus the pressure in the tank line LT1. The pressure in the pressure chambers 30 is transferred via the control line LST4 into the bore 188 of the valve actuator 189, so that the valve actuator 189 is shifted from its left stop-motion position to its right stop-motion position. In this manner the passageway to the bypass line LB is opened up via the bores 190*a* and 190*c;* the check valve 176 opens up, and the flow of oil from the pressure chambers 30 can be returned via the bypass line LB directly to the tank line LT1 and thus to the pressure chambers 28, avoiding the oil tank T.

The above-described functioning of the switch 174 can also be applied when the solenoid valve 168 is exposed to hydraulic flow with a simultaneous reversal in adjustment direction of the adjustment unit 4.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Device for adjusting the relative angle of rotation of a camshaft with respect to a crankshaft of an internal combustion engine, with a hydraulically activated actuating element, through adjustment of which a phase position of the camshaft can be directly or indirectly changed, whereby the actuating element is bordered by two pressure chambers, which pressure chambers can be loaded with or relieved of hydraulic fluid via control lines, and with a control valve, which, depending upon the operating state of the internal combustion engine, forces a flow of oil that is forced from an oil reservoir by an oil pump via a first control line to a first pressure chamber, while oil from a second pressure chamber is returned to the oil reservoir via a second control line, and vice versa, wherein at least one controlled bypass is arranged between the two pressure chambers, and wherein the bypass can be controlled via at least one valve element and is integrated into the actuating element, whereby the actuating element is designed as an inner component that is connected to the camshaft such that it cannot rotate, is equipped with fixed members or vanes that extend at least nearly radially, and is encompassed by a driven cell wheel, which is equipped with several cells that are distributed around its circumference and are bordered by fixed members, with each of these cells being divided by the fixed members or vanes of the inner component, which are capable of angular movement, into two pressure chambers.

2. Device according to claim 1, wherein four bores are provided in the inner component, in which bores the supply of oil to the two pressure chambers and to valve pins that control the bypass between the two pressure chambers are arranged such that they can be shifted.

3. Device according to claim 2, wherein a valve pin that controls the supply of oil to the pressure chamber is also designed as a locking element that acts between the inner component and the cell wheel, wherein said locking element operates in conjunction with at least one counter element in the other of the two component cell wheel and inner component.

4. Device according to claim 2, wherein all four bores are arranged in one vane of the inner component.

5. Device according to claim 3, wherein all four bores are arranged in one vane of the inner component.

* * * * *

UNITED STATES PATENT AND TRADEMARK OFFICE

CERTIFICATE OF CORRECTION

PATENT NO. : 6,941,912 B2
DATED : September 13, 2005
INVENTOR(S) : Edwin Palesch It is certified that error appears in the above-identified patent and that said Letters Patent is hereby corrected as shown below:

Title page,
Item [30], Foreign Application Priority Data, should read:
-- February 9, 2002 (DE).....102 05 415.0 --.

Signed and Sealed this

Thirty-first Day of January, 2006

JON W. DUDAS
*Director of the United States Patent and Trademark Office*